US007006114B2

(12) United States Patent
Sakaguchi

(10) Patent No.: US 7,006,114 B2
(45) Date of Patent: Feb. 28, 2006

(54) DISPLAY DRIVING APPARATUS AND DISPLAY APPARATUS USING SAME

(75) Inventor: Nobuhisa Sakaguchi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 279 days.

(21) Appl. No.: 10/347,457

(22) Filed: Jan. 21, 2003

(65) Prior Publication Data

US 2003/0137526 A1 Jul. 24, 2003

(30) Foreign Application Priority Data

Jan. 21, 2002 (JP) ..... 2002-011975
Mar. 15, 2002 (JP) ..... 2002-073127

(51) Int. Cl.
*G09G 5/10* (2006.01)

(52) U.S. Cl. ..... 345/690; 345/87; 345/88; 345/89; 345/90; 345/91; 345/92; 345/93; 345/94; 345/95; 345/96; 345/97; 345/98; 345/99; 345/100; 345/204; 345/692; 345/693

(58) Field of Classification Search ..... 345/87–100, 345/204, 690, 692, 693
See application file for complete search history.

(56) References Cited

U.S. PATENT DOCUMENTS 5,343,221 A * 8/1994 Arakawa et al. ..... 345/211
5,623,279 A * 4/1997 Itakura et al. ..... 345/98

(Continued)

FOREIGN PATENT DOCUMENTS

JP 06-348235 12/1994
JP 6348235 12/1994
JP 06348235 A * 12/1994
JP 2001-034234 2/2001

OTHER PUBLICATIONS

Webopedia, http://www.webopedia.com/Term/b/big_endian.html.*
Jargon File (4.3.1, Jun. 29, 2001); http://dict.die.net/big-endian/.*

(Continued)

*Primary Examiner*—Sumati Lefkowitz
*Assistant Examiner*—Alexander S. Beck
(74) *Attorney, Agent, or Firm*—Harness, Dickey & Pierce, P.L.C.

(57) ABSTRACT

A standard voltage generating circuit generates standard voltages as many as the number of gradations. Then, the standard voltages are separated into standard voltages of high level and those of low level, by a selector circuit, regardless of polarities thereof. One of the standard voltages of high level thus separated by the selector circuit is selected by a Pch-arranged converting section of a D/A converting circuit. Then, the selected one of the standard voltages of high level is outputted as a gradation-display-use voltage. Meanwhile, One of the standard voltages of low level thus separated by the selector circuit is selected by an Nch-arranged converting section of the D/A converting circuit. Then, the selected one of the standard voltages of low level is outputted as a gradation-display-use voltage. With this arrangement, it is possible to attain miniaturization of a circuit and lower power consumption in a display apparatus which performs gradation display by a voltage modulation method.

16 Claims, 20 Drawing Sheets

U.S. PATENT DOCUMENTS 6,483,522 B1 * 11/2002 Chen et al. ..... 345/690
6,529,180 B1 * 3/2003 Ito et al. ..... 345/89
6,567,066 B1 * 5/2003 Hashimoto ..... 345/100
6,577,293 B1 * 6/2003 Kwon ..... 345/89
6,693,614 B1 * 2/2004 Kamiya et al. ..... 345/89
6,806,859 B1 * 10/2004 Kanoh et al. ..... 345/98
2002/0030656 A1 * 3/2002 Goto et al. ..... 345/89
2002/0093475 A1 * 7/2002 Hashimoto ..... 345/87

OTHER PUBLICATIONS

Jargon File (4.3.1, Jun. 29, 2001); http://dict.die.net/little-endian/.*

* cited by examiner

A VOLTAGE LUMINANCE PROPERTY
DIAGRAM OF TFT LIQUID CRYSTAL

DISPLAY DRIVING APPARATUS AND DISPLAY APPARATUS USING SAME

FIELD OF THE INVENTION

The present invention relates to a display driving apparatus for driving a liquid crystal panel and the like, and a display apparatus including the same, and particularly relates to a display driving apparatus, which realizes miniaturization of a driving circuit and reduction in power consumption of the driving circuit, and a display apparatus including the same.

BACKGROUND OF THE INVENTION

The Active matrix method is one of various display methods for a liquid crystal display apparatus. The active matrix method, which attains a very fine display, uses TFTs (Thin Film Transistor) as switching elements.

In a liquid crystal display apparatus using the active matrix method, TFTs are tuned ON, line by line, in accordance with a scanning signal outputted from a gate driver. Via the TFT, a driving voltage is applied from a source driver to a pixel electrode connected to a drain of the TFT thus turned ON. Whereby, an electric charge is accumulated in a pixel capacitor between the pixel electrode and a counter electrode. This changes light transmittance of a liquid crystal, whereby display is performed.

One of applicable methods for performing gradient display in such liquid crystal display apparatus is a method in which a driving voltage outputted from a source driver is supplied as a gradient display voltage, which is in accordance with brightness of a pixel of a display object.

Here, an arrangement of the source driver is described referring to FIG. 13. A source driver 1010 shown in FIG. 13 receives, as inputs, a start pulse signal SP, a clock signal CK, digital display data DR, DB, a latch signal LS, and a reference voltage VR.

Each digital display data DR, DG, DB (for example, respectively having 6 bits), which are transmitted from a controller (control circuit), are latched by an input latch circuit 1011, temporally. Note that the digital display data DR, DG, and DB respectively correspond to red, green, and blue.

On the other hand, the start pulse signal SP for controlling transmission of the digital display data is, in synchronism with the clock signal CK, transmitted through a shift register circuit 1012 and outputted as a start pulse signal SP (a cascade output signal S) from a last stage of the shift register circuit and to a source driver, which is a next stage of the last stage of the shift register circuit.

In synchronism with output signals from respective stages of the shift register circuit 1012, the digital display data DR, DG, and DB, which have been latched by the input latch circuit 1011, are temporally stored in a sampling memory circuit 1013 in a time-sharing manner, and outputted to a hold memory circuit 1014, which is a next stage of the sampling memory circuit 1013.

When the digital display data that corresponds to a pixel in a horizontal line of a screen is stored in the sampling memory circuit 1013, the hold memory circuit 1014 receives an outputs signal from the sampling memory circuit 1013 in accordance with a horizontal synchronizing signal (latch signal LS), and outputs, to a level shifter circuit 1015, which is a next stage of the hold memory circuit 1014, the output signal from the sampling memory circuit 1013. Further, the hold memory circuit 1014 keeps the display data until a next horizontal synchronizing signal is inputted.

The level shifter circuit 1015 is a circuit for converting a signal level of a signal by increasing a voltage thereof, or the like method, in order to make the signal be conformable with D/A converting circuit 1016 for processing an applied voltage level of the signal which is applied to a liquid crystal panel.

A standard voltage generating circuit 1019 generates various analog voltages for the gradient display in accordance with a reference voltage VR inputted from a liquid crystal driving power source, and outputs the analog voltages to a D/A converting circuit 1016.

In accordance with the digital display data, which has been subjected to the level conversion by the level shifter circuit 1015, the D/A converting circuit 1016 selects one of the various analog voltages supplied from the standard voltage generating circuit 1019. The analog voltage indicating the gradation display is outputted via an output circuit 1017 from each liquid crystal driving voltage output terminal (hereinafter, just referred to as output terminals) 1018 to each source signal line of the liquid crystal panel.

The output circuit 1017, which is basically a buffer circuit for performing low impedance conversion, is composed of a voltage follower circuit using a differential amplifier circuit, for example.

Next, the standard voltage generating circuit 1019 and D/A converting circuit 1016 are described in more details as to their circuit arrangement.

FIG. 14 illustrates a circuit arrangement example of the standard voltage generating circuit 1019. In case each digital display data for RGB is composed of 6 bits, the standard voltage generating circuit 1019 outputs sixty-four levels of analog voltages corresponding to $2^6$=sixty-four gradation displays. In the following, a specific arrangement thereof will be explained.

The standard voltage generating circuit 1019 is composed of resistive divider circuits, in which resistors $R_0$ to $R_7$ are connected in series, thus having a simplest arrangement. Each of the respective resistors $R_0$ to $R_7$ are composed of eight resistance elements connected in series.

The resistor $R_0$ will be explained as an example. As shown in FIG. 15, $R_0$ is composed of resistance elements $R_{01}$, $R_{02}$, . . . $R_{08}$ connected in series. The other resistors $R_1$ to $R_7$ have the same arrangement. Therefore, the standard voltage generating circuit 1019 is composed of sixty-four resistance elements connected in series, in total.

Moreover, the standard voltage generating circuit 1019 is provided with nine intermediate voltage input terminals for nine levels of reference voltages $V'_0$ $V'_8$ . . . $V'_{56}$ $V'_{64}$. Moreover, the intermediate voltage input terminal for the reference voltage $V'_{64}$ is connected to an end of the resistor R0, meanwhile the intermediate voltage input terminal for the reference voltage $V'_{56}$ is connected to the other end of the resistor $R_0$, that is, a node between the resistor $R_0$ and $R_1$.

In the same manner, the intermediate voltage input terminals for the reference voltages $V'_{48}$ $V'_{40}$ . . . $V'_{08}$ are connected respectively to nodes between the neighboring pair of the resistors $R_1$ and $R_2$, $R_3$ and $R_4$, . . . $R_6$ and $R_7$. Further, in the resistor $R_7$ the intermediate voltage input terminal for the reference voltage $V'_0$ is connected to one node that is not connected to the resistor $R_6$ (the other one node is connected to the resistor $R_6$).

With this arrangement, it is possible to obtain 64 levels of analog voltages $V_0$ to $V_{63}$ for gradation display. The 64 levels of analog voltages $V_0$ to $V_{63}$ include the voltages $V_1$ to $V_{63}$, which are obtained from the pairs of the neighboring sixty four resistors, and a voltage $V_0$ obtained from the reference voltage $V'_0$. Moreover, in the liquid crystal display apparatus, a polarity of the driving voltage, which is to be supplied to a the pixel electrode in order to reliability thereof, is inverted. That is, where gradation-display-use analog voltages for positive polarity (gradation-display-use positive polarity analog voltages) are $+V_0$ to $+V_{63}$, gradation-display-use analog voltages for negative polarity (gradation-display-use negative polarity analog voltages) are $-V_0$ to $-V_{63}$. Furthermore, an output from the standard voltage generating circuit 1019 is outputted in such a manner that each of the gradation-display-use positive polarity analog voltages $+V_0$ to $+V_{63}$ and each of the gradation-display-use negative polarity analog voltages $-V_0$ to $-V_{63}$ are outputted from a terminal from which a corresponding counterpart voltage thereof (for example, for the positive polarity analog voltage $+V_0$, is outputted from the terminal from which its counterpart voltage, that is the negative polarity analog voltage $-V_0$, is outputted).

Next, in an example where the standard voltage generating circuit 1019 is composed of a resistive divider circuit, the voltages $V_0$ to $V_{63}$ are inputted from the standard voltage generating circuit 1019 to the D/A converting circuit 1016.

Next, the D/A converting circuit 1016 will be explained. FIG. 16 shows an example of arrangements of the D/A converting circuit 1016. Note that, the reference numeral 1017 indicates the arrangement of the output circuit (voltage follower circuit) discussed previously.

In the D/A converting circuit 1016, for example, MOS transistors or transmission gates are provided as analog switches so that one of the inputted 64 levels of the voltage $V_0$ to $V_{63}$ is selected in accordance with the display data composed of the digital signals of 6 bits, and outputted. That is, the switch is turned ON/OFF in accordance with the respective display data (bit 0 to bit 5) composed of the digital signals of 6 bits. In this way, one of the sixty-four levels of voltages is selected and outputted to the output circuit 1017. This is explained below.

Among the digital display data of 6 bits, Bit 0 is an LSB (the Least Significant Bit) and Bit 5 is an MSB (the Most Significant Bit). Each two of the switches forms a switching pair. Thirty two switching pairs (sixty-four switches) are provided to deal with Bit 0, while sixteen switching pairs (thirty-two switches) are provided to deal with Bit 1.

Likewise, a half number of the switching pairs are provided to the next less significant bit. Thus, one switching pair (two switches) is provided to deal with Bit 5. Therefore, there existed $2^5+2^4+2^3+2^2+2^1+1$=sixty three pairs (one-hundred-and-twenty-six switches) in total.

One end of each switch for Bit 0 is a terminal for receiving one of the voltages $V_0$ to $V_{63}$. The other end of each switch for Bit 0 is connected that of the mate thereto, and to one end of each switch for Bit 1. Likewise, similar arrangements are repeated until the switches for Bit 5. At last, one line is drawn out of the switches for Bit 5 and connected to the output circuit 1017.

Hereinafter, the switches for Bit 0 to Bit 5 are referred as switch groups SW0 to SW5, respectively. Each switch of the switch groups SW0 to SW5 is controlled in accordance with digital display data (Bit 0 to Bit 5) of 6 bits as follows. In the switch groups SW0 to SW5, one mate of the pairs of the analog switches (in FIG. 16, the mate of a lower position (hereinafter, referred to as lower switches)) are turned ON when their related Bits are 0 (low level). On the contrary, the other mate of the pairs of the analog switches (in FIG. 16, the mate of an upper position (hereinafter, referred to as upper switches)) when their related Bits are 1 (high level).

In FIG. 16, Bit 0 to Bit 5 are (111111). Thus, the upper switches of the all pairs of switches are turned ON, while the lower switches thereof are turned OFF. In this case, the D/A converting circuit 1016 outputs the voltage $V_{63}$ to the output circuit 1017. Likewise, for example in case where Bit 0 to Bit 5 are (111110), the D/A converting circuit 1016 outputs the voltage $V_{62}$ to the output circuit 1017. In case where Bit 0 to Bit 5 are (000001), the D/A converting circuit 1016 outputs the voltage $V_1$. Further, in case where Bit 0 to Bit 5 are (000000), the D/A converting circuit 1016 outputs the voltage $V_0$ to the output circuit 1017. In this way, one of the analog voltages $V_0$ to $V_{63}$ for gradation display is selected so as to realize the gradation display.

Usually, one standard voltage generating circuit 1019 is provided in each source driver IC, and used in a sharing manner. On the other hand, the same number of D/A converting circuits 1016 and output circuits 1017 and the output terminals 1018 are provided (that is, the D/A converting circuits 1016 and output circuits 1017 in the same number as the output terminals 1018), in order that one D/A converting circuit 1016 and one output circuit 1017 are provided for each output terminal 1018.

Moreover, in case of the color display, one output terminal 1018 is provided for each color. In this case, one D/A converting circuit 1016 and one output circuit 1017 are provided for each pixel, or each color.

Specifically, where there provided a 3N number of pixels along a longitudinal direction (horizontal line) of the liquid crystal panel, and the output terminals 1018 respectively for red, green and blue are labeled with the reference characters R, G, and B with reference numerals n (n=1, 2, . . . , N), the output terminals 1018 are shown as $R_1$, $G_1$, $B_1$, $R_1$, $G_1$, $B_1$, . . . , and $R_N$, $G_N$, $B_N$. Suppose, for example, that the liquid crystal panel is driven with eight source drivers IC, each source driver needs a 3N/8 number of D/A converting circuits 1016 and the output circuits 1017.

Incidentally, in reality, the Y correction is carried out in the gradation display in the liquid crystal display apparatus. The Y correction adjusts the difference between light transmittance property of liquid crystal materials and visual sense of humans, thereby realizing a natural gradation display. The Y correction is generally carried out by using the standard voltage generating circuit having an arrangement in which internal resistors are divided unequally (but not equally divided) so as to generate various levels of analog voltages for gradation display.

FIG. 17 illustrates a relationship between gradation display data (digital display data) and a liquid crystal driving output voltage (analog voltage for gradation display). As shown in FIG. 17, with respect to the digital display data, the values of the analog voltage for gradation display shows, on the graph, a line that bents at several points. (Hereinafter, this property of the values is referred to as a bent line property. That is, the values of the analog voltage for gradation display have the bent line property.)

In order to give the bent line property to the values of the analog voltage for gradation display, the standard voltage generating circuit 1019 shown in FIG. 14 is so arranged that the resistive resistance values in the resistors $R_0$, . . . , and $R_7$ are evenly divided into eight, and the resistors $R_0$, . . . , and $R_7$ have such values that the aforementioned Y correction is realized with the values.

Specifically, the resistance values of the eight resistance elements, for example, the resistance elements $R_{01}$, $R_{02}$, . . . , and $R_{08}$ connected in series forming the resistor $R_0$, have the same resistance values, while the resistors $R_0$, $R_1$, . . . , and $R_7$, which are respectively composed of the eight resistance elements, have resistance values in such a ratio that the aforementioned Y correction is realized when the resistance values of the resistors $R_0$, $R_1$, . . . , and $R_7$ are in the ratio.

Incidentally, the research and development for the liquid crystal display apparatus have been focused on realization of a larger screen for use in televisions, personal computers and the like. On the other hand, there is a demand for a liquid crystal display apparatus and liquid crystal driving apparatus suitable for use in personal display apparatus for personal terminals such as personal telephones and the like, whose market is rapidly growing.

The liquid crystal display apparatus, in which the liquid crystal driving apparatus is used, and which is suitable for use in the personal terminals, basically have a small screen size. In conformity with the small screen size, the liquid crystal driving apparatus should be small in size and light in weight, and further should have a low power consumption so that a battery can be used for driving.

Here, each switch constituting the D/A converting circuit 1016 is conventionally composed of a CMOS transistor (combination of a PchMOS transistor and an NchMOS transistor), for the reason explained below.

In case of the aforementioned arrangement in which all the inputted gradation standard voltages are inputted into the same D/A converting circuit and the polarity inversion of the gradation standard voltage is carried out, each switch in the D/A converting circuit receive both the reference voltages of high level and reference voltages of low level.

For example, the switch that receives a voltage of $+V_{63}$ (high level) when the polarity is positive, receives a voltage of $-V_{63}$ (low level) when the polarity is negative, where the voltages of $+V_0$ to $+V_{31}$ are of low level (in a low voltage group) while the voltages $+V_{32}$ to $+V_{63}$ are of high level (in the high voltage group) when the polarity is positive, while the voltages of $-V_0$ to $-V_{31}$ are of high level (in a high voltage group) while the voltages $-V_{32}$ to $-V_{63}$ are of low level (in the low group) when the polarity is negative.

In this case, if the switches of the D/A converting circuit are constituted solely of a PchMOS transistor, the output of the D/A converting circuit is distorted when the voltage is of low level, while if the switches of the D/A converting circuit are composed solely of an NchMOS transistor, the output of the D/A converting circuit is distorted when the voltage is of high level. Thus, if the switches of the D/A converting circuit are composed solely of either a PchMOS transistor or an NchMOS transistor, normal D/A conversion output may not be attained. Because of this, the two types of transistors are combined to constitute the switches in the prior art. With this arrangement, the PchMOS transistor is mainly operated when the voltage of high level is inputted, while the NchMOS transistor is mainly operated when the voltage of low level is inputted, whereby the switching relating to D/A converting process is normally operated.

However, in the arrangement in which each one switch is composed of the two transistors, a great number of transistors are provided on a chip, resulting in an increase in a substrate area. This gives the driving circuit a large circuit arrangement, that is, causes the liquid crystal display apparatus to be larger (in other words, this hinders miniaturizations of the liquid crystal display apparatus).

Moreover, in case each one switch is composed of the PchMOS transistor and NchMOS transistor in combination, those transistors are formed on the same substrate. In this case, it is a problem that back gate effect due to substrate bias is caused in at least either the PchMOS transistor or NchMOS transistor, thereby causing drop in output voltage.

SUMMARY OF THE INVENTION

The present invention has an object to provide a display driving apparatus capable of realizing miniaturization of a driving circuit and reduction in power consumption of the driving circuit in a display apparatus for performing gradation display by the voltage modulation method, and the display apparatus including the same.

In order to attain the object, a display driving apparatus of the present invention for supplying a gradation-use voltage to a data signal line of a display panel of active matrix type, the gradation-use voltage being inverted in polarity in a predetermined polarity inverting cycle, and being adjusted in accordance with display data, the display driving apparatus includes: a standard voltage generating section for generating standard voltages as many as gradations; a separating section for separating, into a high voltage group and a low voltage group, the standard voltages having been generated by the standard voltage generating section; a first D/A (digital-analog) converting section for (a) receiving the standard voltages in the high voltage group, (b) selecting one of the thus inputted standard voltages in the high voltage group by controlling open/close of switches in accordance with the display data, and (c) outputting the thus selected standard voltage as the gradation-display-use voltage; and a second D/A converting section for (d) receiving the standard voltages in the low voltage group, (e) selecting one of the thus inputted standard voltages in the low voltage group by controlling open/close of switches in accordance with the display data, and (f) outputting the thus selected standard voltage as the gradation-display-use voltage.

With the above arrangement, the standard voltage generating section generates the standard voltages as many as the gradations required for gradation display. The polarities of the standard voltages are inverted in the predetermined cycle. The standard voltages generated by the standard voltage generating means is separated, by the separating section, into the high voltage group and the low voltage group.

The first D/A converting section selects one of the standard voltages separated into the high voltage group by the separating section, while the second D/A converting section selects one of the standard voltages separated into the low voltage group by the separating section. The thus selected standard voltages are outputted as the gradation-display-use voltage (voltage for gradation display).

In this arrangement, the first D/A converting section always carries out the selection as to the standard voltages in the high voltage group only, even though the gradation-display-use voltage is to be subjected to the inversion of polarity. Therefore, it is possible to compose the first D/A converting section of switches that properly operate for input of high voltages (but cause distortion for input of low voltages), such as the PchMOS transistor and the like.

Likewise, it is possible to compose the second D/A converting section of switches that properly operate for input of low voltages (but cause distortion for input of high voltages), such as the NchMOS transistor and the like.

This eliminates a need of the arrangement in which one switch is composed of two transistor as in the prior art in order to attain proper operation to deal with both the high and low voltages. Thus, this reduces the number of switches (for example, transistors) to be used in D/A conversion, thereby giving a circuit for the D/A conversion a smaller layout area, thus attaining miniaturization of the display driving circuit.

Moreover, the arrangement in which the first and second D/A converting sections are respectively composed of either one type of transistors, namely PchMOS transistors or NchMOS transistors, allows the first and second D/A converting sections to be formed on separate substrates. In this arrangement, it is possible to ignore voltage drop due to back gate by appropriately setting the standard voltages that are to be supplied respectively to the first and second D/A converting sections, thereby attaining low power consumption in switching of the D/A conversion.

For a fuller understanding of the nature and advantages of the invention, reference should be made to the ensuing detailed description taken in conjunction with the accompanying drawings.

DESCRIPTION OF THE EMBODIMENTS

[First Embodiment]

Described below is an embodiment of the present invention referring to drawings.

Figure 2:
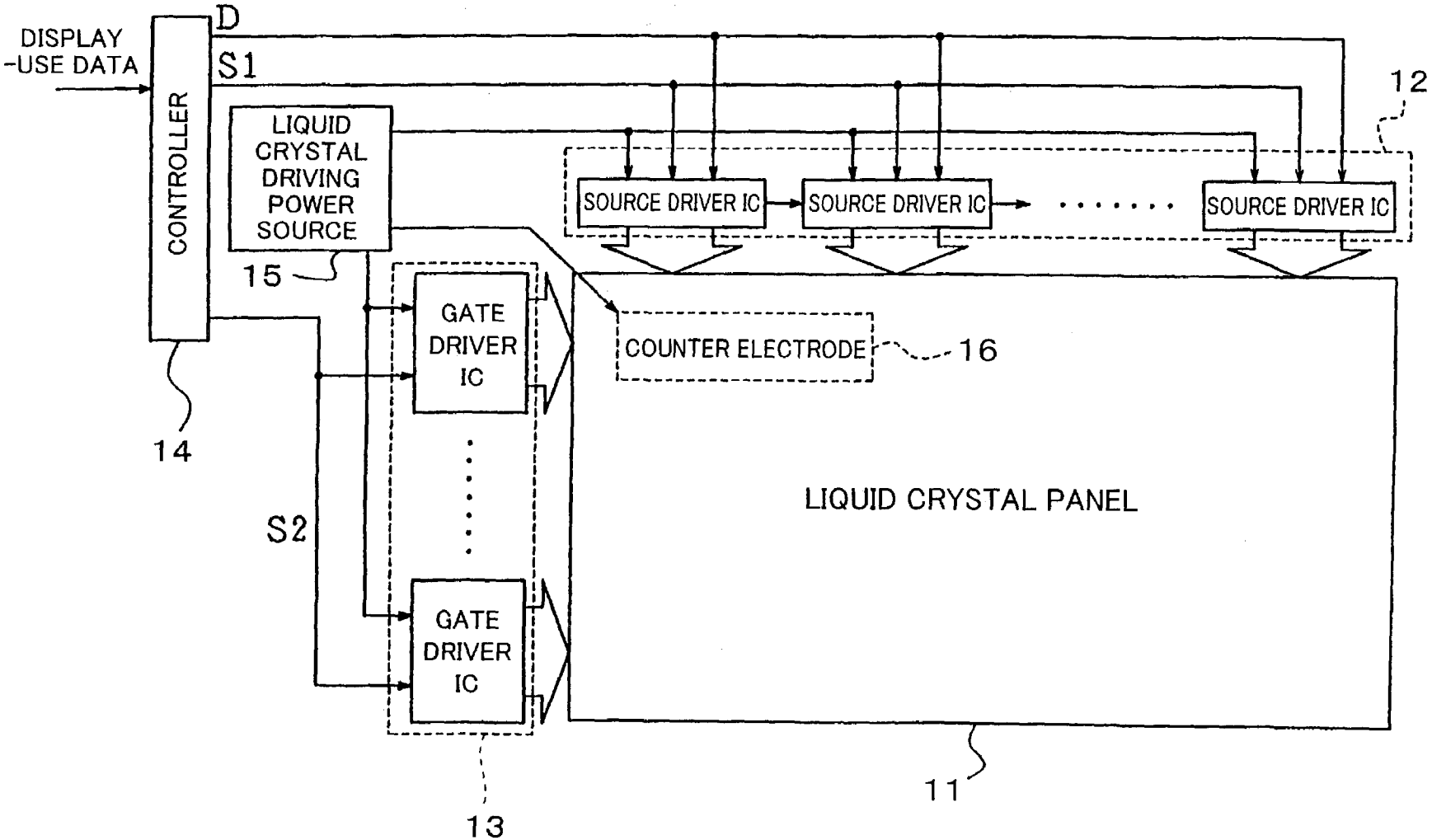
FIG. 2 is a block diagram illustrating an arrangement of a liquid crystal display apparatus using the liquid crystal driving apparatus.

With reference to FIG. 2, a liquid crystal display apparatus of the active matrix type pertaining to the present embodiment. In the following, discussed as an example is a liquid crystal display apparatus of the TFT (Thin Film Transistor) type, which is a typical liquid crystal display apparatus of the active matrix type.

The liquid crystal display apparatus is provided with a liquid crystal display section and a liquid crystal driving apparatus for driving the liquid crystal display section. The liquid crystal display section includes a liquid crystal panel (display panel) 11 of the TFT type. In the liquid crystal pane 11, liquid crystal display elements (not shown) and counter electrodes (common electrodes) 16, which are discussed later, are provided. Meanwhile, the liquid crystal driving apparatus is provided with a source driver (display driving apparatus) 12, a gate driver 13, a controller 14 and a liquid crystal driving power source 15. The source driver 12 and the gate driver 13 are respectively composed of ICs (Integrated Circuits).

In general, the source driver 12 and the gate driver 13 are provided by, for example, (a) mounting and connecting, on an ITO (Indium Tin Oxide) terminal on the liquid crystal panel, a TCP (Tape Carrier Package) in which the IC chips are mounted on a film on which wirings are provided, or (b) directing mounting and connecting the IC chips to the ITO terminal on the liquid crystal panel via an ACF (Anisotropic Conductive Film) by means of thermo compression bonding.

In some prior arts, the controller 14, the liquid crystal driving power source 15, the source driver 12, the gate driver 13 are provided on a single chip or two or three chips. In FIG. 2, the arrangement of those sections are separately illustrated in terms of functions.

The controller 14 outputs, to the source driver 12, digitalized display data (for example, signals for R, G, B corresponding to red, green and blue) and various control signals, and outputs various control signals to the gate driver 13. The control signals for the source driver 12 are mainly a horizontal synchronizing signal, a start pulse signal and a source-driver-use clock signal, and the like signal. The control signals for the source driver 12 are indicated by the reference character S1 in FIG. 2. On the other hand, the control signals for the gate driver 13 are mainly a vertical synchronizing signal, a gate-driver-use clock signal and the like signal. The control signals for the gate driver 13 are indicated by the reference character S2 in FIG. 2. Note that a power source for driving each IC is omitted in the illustration in FIG. 2.

The liquid crystal driving power source 15 supplies, to the source driver 12 and the gate driver 13, a voltage for displaying the liquid crystal panel (in the present invention, a reference voltage for generating a voltage for performing gradation display).

Digital display data inputted from an outside is inputted to the source driver 12 as display data D (display data DR, DB, and DG discussed previously), after the digital display data is controlled in terms of timing and the like by the controller 14.

The source driver 12 latches therein the inputted display data in a time-sharing manner. Then, the latched display data is latched and subjected to D/A conversion (from digital to analog) in accordance with the horizontal synchronizing signal (also called a latch signal LS (see FIG. 1)) inputted from the controller 14, thereby obtaining an analog voltage for gradation display (gradation-display-use voltage). Then, the source driver 12 outputs the analog voltage for gradation display from liquid crystal driving voltage output terminals via later described source signal lines 24 to respective liquid crystal display elements (not shown) corresponding thereto and provided in the liquid crystal panel 11.

Figure 3:
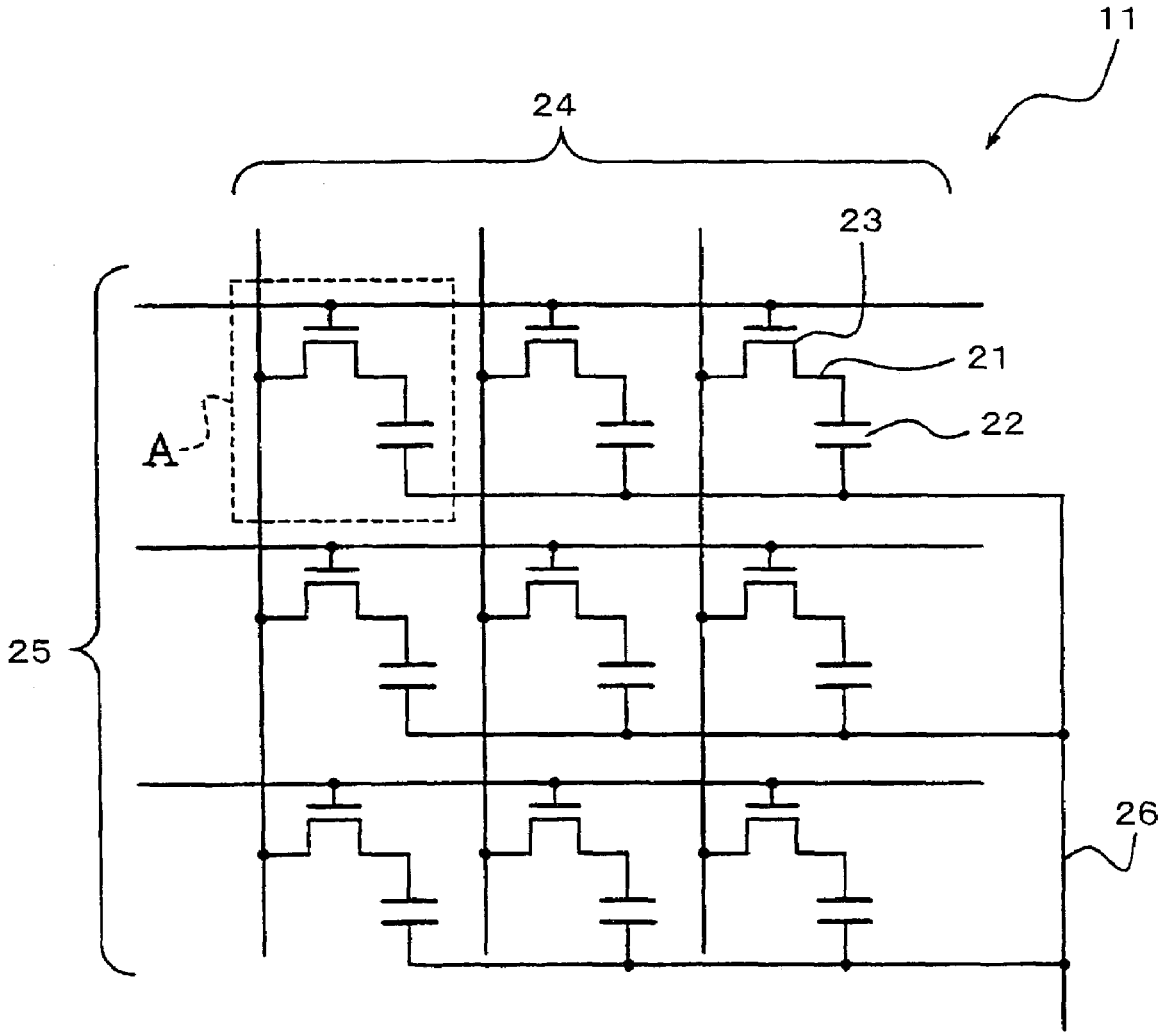
FIG. 3 is a circuit diagram illustrating a schematic arrangement of a liquid crystal panel of the liquid crystal display apparatus.

Next, the liquid crystal panel 11 is explained. FIG. 3 shows an arrangement of the liquid crystal panel 11.

The liquid crystal panel 11 is provided with pixel electrodes 21, pixel capacitors 22, TFTs 23 as elements for turning ON/OFF an applied voltage to be applied onto the pixel, source signal lines 24, gate signal lines 25, and a counter electrode 26. In FIG. 3, an area indicated by the reference character A corresponds to a liquid crystal display element of one pixel.

To the source signal line 24, the source driver supplies a gradation display voltage that is in accordance with brightness of a pixel of a display object. Meanwhile, the gate driver 13 supplies to the gate signal line 25 a scanning signal so as to sequentially turn ON the TFTs 23 vertically lined up (that is, lined up in up and down directions with respect to FIG. 3).

The voltage of the source signal lines 24 is applied, via the TFTs 23 thus turned ON, onto the pixel electrodes 21 connected to those TFTs 23. This voltage is accumulated in the pixel capacitors 22 between the pixel electrodes 21 and the counter electrodes 26. This causes light transmittance of a liquid crystal to change, thereby performing display.

Figure 4:
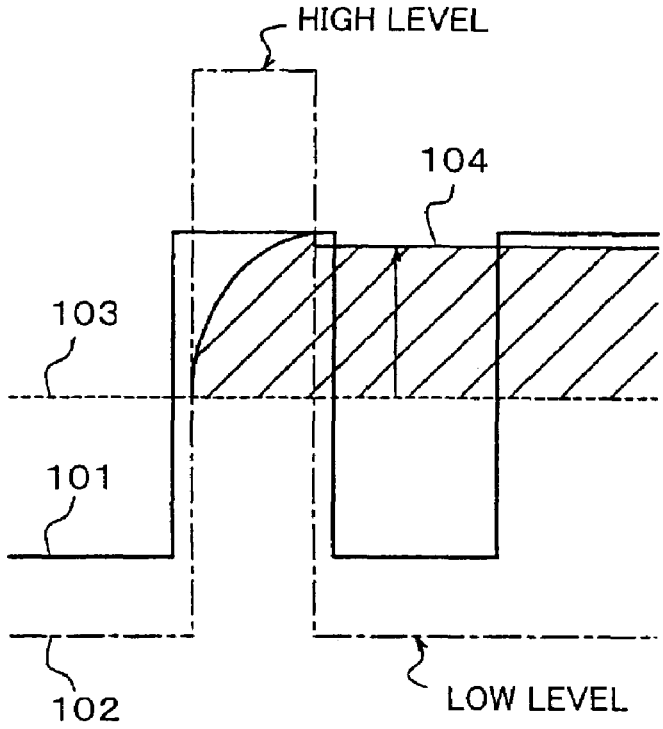
FIG. 4 is a waveform chart showing an example of a liquid crystal driving waveform in the liquid crystal display apparatus.
Figure 5:
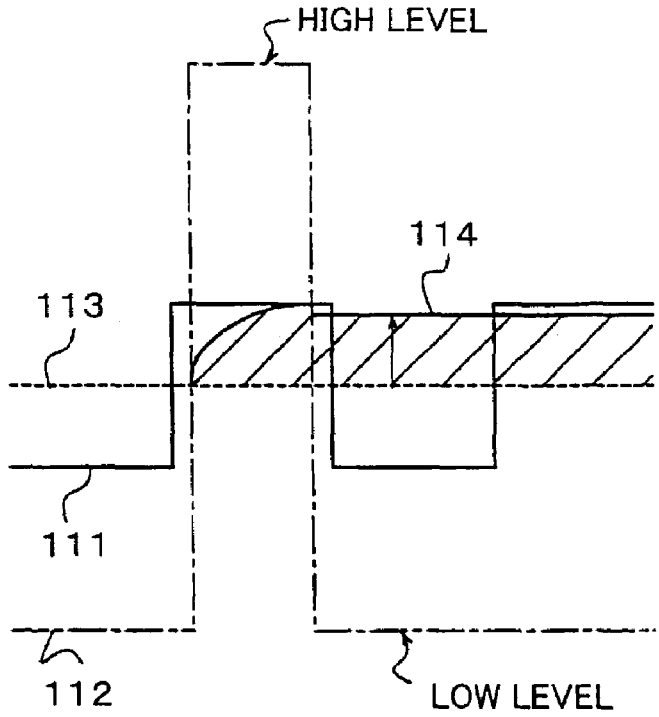
FIG. 5 is a waveform chart showing an example of a liquid crystal driving waveform in the liquid crystal display apparatus.

FIGS. 4 and 5 illustrate examples of liquid crystal driving waveforms. In FIGS. 4 and 5, the reference numerals 101 and 111 indicate driving waveforms of the output signal from the source driver 12, while the reference numerals 102 and 112 indicate driving waveforms output signals from the gate driver 13. The reference numerals 103 and 113 indicate a potential of a counter electrode 16, while the reference numerals 104 and 114 indicate a voltage waveform of a pixel electrode 21. The voltage to be applied on the liquid crystal display elements is a potential difference between the pixel electrode 21 and the counter electrode 16. The voltage to be applied on the liquid crystal display elements is shown by shading.

For example, in FIG. 4, the TFTs 23 are turned ON when the output signal from the gate driver 13, which is indicated by the driving waveform 102, is of high level. Thus, a difference between the output signal from the source driver 12, which is indicated by the driving waveform 101, and the potential 103 of the counter electrode 16 is applied on the pixel electrode 21. Thereafter, as indicated by the driving waveform 102, the output signal from the gate driver 13 is dropped to a low level, thus turning OFF the TFTs 23. At this moment, the voltage is kept in the pixel by the pixel capacitor 12. A similar operation is carried out in FIG. 5 likewise.

FIGS. 4 and 5 illustrate cases where different voltages are applied on the liquid crystal display elements. The voltage to be applied on the liquid crystal display element in FIG. 4 is higher than that in FIG. 5. The light transmittance of the liquid crystal is analogized by converting, to an analog voltage, the voltage to be applied onto the liquid crystal display element. Thereby, a number of gradations are displayed. A number of possible levels of the analog voltage to be applied on the liquid crystal display element determines a number of displayable gradations.

In the following, the liquid crystal driving apparatus is explained, mainly discussing the source driver 12 including the characteristic part of the present invention.

Figure 1:
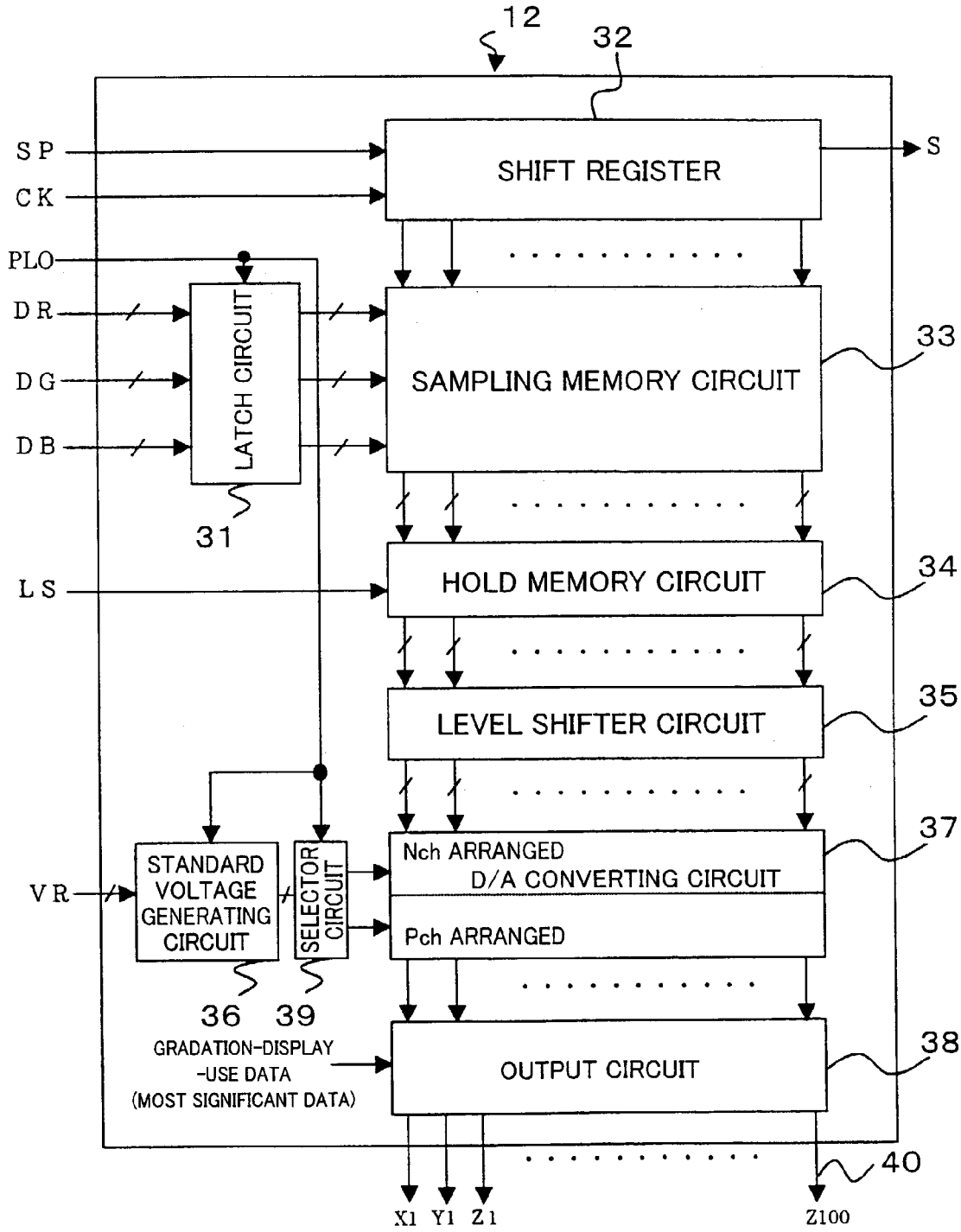
FIG. 1 is a block diagram illustrating an arrangement of a liquid crystal driving apparatus, showing an embodiment of the present invention.

FIG. 1 shows a schematic arrangement of the source driver 12 as the liquid crystal driving apparatus of the first embodiment. The source driver 12 is provided with an input latch circuit 31, a shift register circuit 32, a sampling memory circuit 33, a hold memory circuit 34, a level shifter circuit 35, a standard voltage generating circuit 36, a DA converting circuit 37, an output circuit 38, and a selector circuit 39.

Each digital display data DR, DG, and DB (for example of 6 bits) transmitted from the controller 14 (see FIG. 2) is latched into the input latch circuit 31, temporarily, where the digital display data DR, DG, and DB respectively correspond to red, green, and blue.

On the other hand, a start pulse signal SP for controlling the transmission of the digital display data is transmitted through the shift register circuit 32 in synchronism with a clock signal CK, and is outputted, as the start pulse SP (cascade output signal S) from a last stage of the shift register circuit 32 to the source driver, which is next to the last stage of the shift register circuit 32.

In synchronism with output signals outputted respectively from stages of the shift register circuit 32 in accordance with the transmission of the start pulse signal, the digital display data DR, DG, and DB, which has been latched in the input latch circuit 31, are temporarily stored in the sampling memory circuit 33 in a time sharing manner, and outputted to the hold memory circuit 34, which is next to the sampling memory circuit 33.

When the display data in one horizontal synchronizing period (display data for pixels on one horizontal line on a screen) is stored in the sampling memory circuit 33, the hold memory circuit 34 latches the output signal from the sampling memory circuit 33 therein, in accordance with the horizontal synchronizing signal (latch signal LS), and output to the level shifter circuit 35, which is next to the hold memory circuit 34, and holds the display data.

The level shifter circuit 35 converts signal levels of the display data by increasing voltages thereof or the like method, in order that the applied voltage has a voltage level in conformity with the D/A converting circuit 37, which is a next stage of the level shifter circuit 35. The standard voltage generating circuit 36 is provided with two resistive divider circuits (described later in detail). With this arrangement, the liquid crystal display elements can deal with the AC driving in accordance with a reference voltage VR supplied from the liquid crystal driving power source 15 (see FIG. 2). The resistive divider circuits generate various analog voltages (hereinafter, just referred to as standard voltages) of positive polarity and negative polarity, respectively. Note that the two resistive divider circuit is so arranged that one of the standard voltage of positive polarity and the standard voltage of negative polarity is generated by the corresponding one of the resistive divider circuits in accordance with an input polarity inversion signal PLO inputted from the controller 14.

The selector 39 selects one of the standard voltages from the two resistive divider circuit in accordance with polarity of the input polarity inversion signal PLO, and causes the selected one of the standard voltages to be outputted to the DA converting circuit 37 (later described in detail). In accordance with the digital display data subjected to the level shifting by the level shifter circuit 35, the DA converting circuit 37 selects one of the various analog voltages supplied from the standard voltage generating circuit 36.

The standard voltage is outputted via the output circuit 38 from each liquid crystal driving voltage output terminal 40 (hereinafter, just referred as output terminals) to each source signal line of the liquid crystal panel. The output circuit 38 is composed of a voltage follower circuit using a later described differential amplifier circuit.

Figure 8:
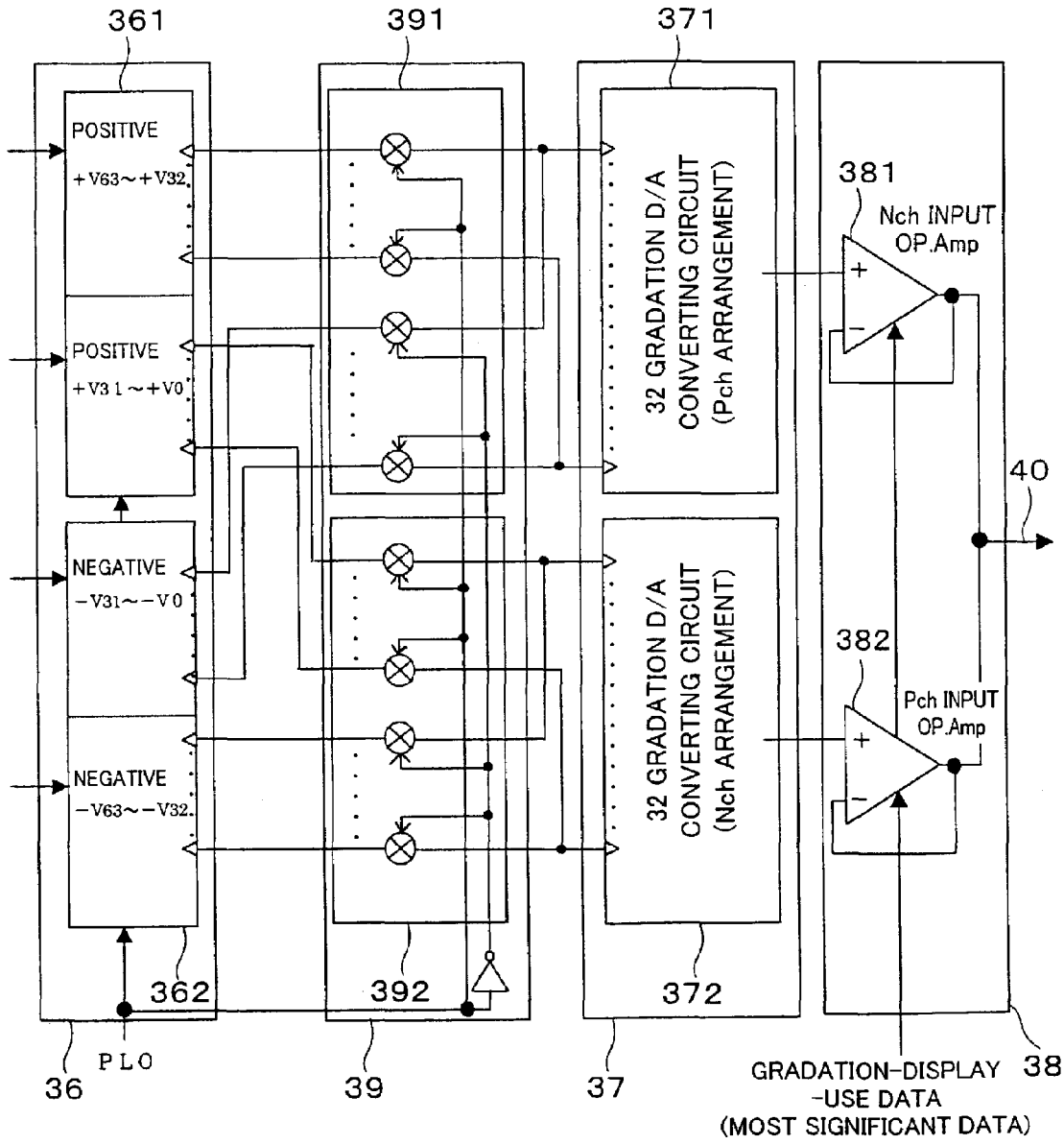
FIG. 8 is a block diagram illustrating how the standard voltage generating circuit, a selector circuit, a D/A converting circuit and an output circuit are arranged in the liquid crystal driving apparatus.

Next, specific examples of the standard voltage generating circuit 36, the selector circuit 39, the D/A converting circuit 37, and the output circuit 38 are explained, with reference to FIG. 8 illustrating in detail the block arrangement of the standard voltage generating circuit 36, the selector circuit 39, the D/A converting circuit 37, and the output circuit 38, which especially relate to the present invention.

Figure 6:
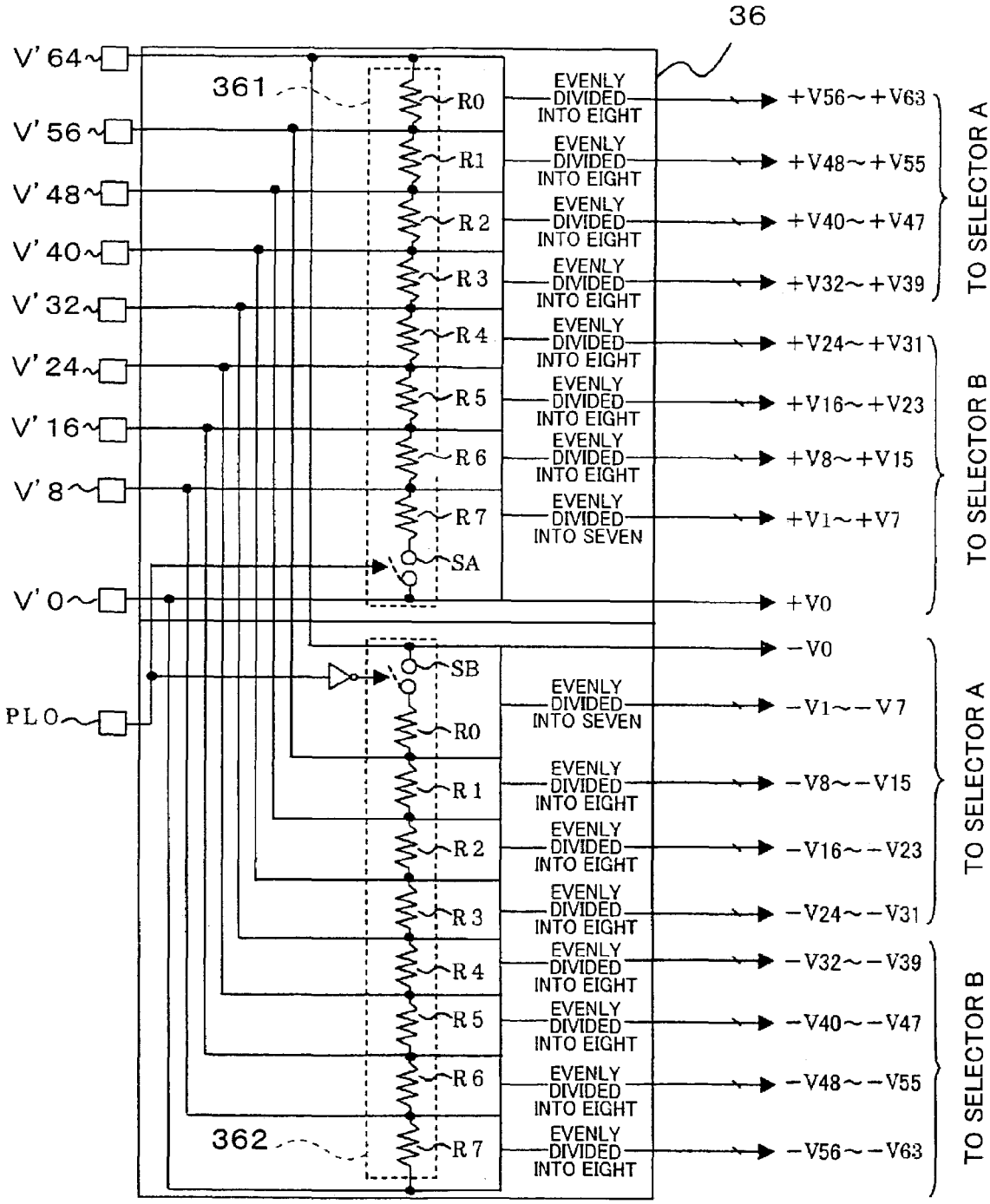
FIG. 6 is a circuit diagram showing an arrangement of a standard voltage generating circuit in the liquid crystal driving apparatus.

FIG. 6 illustrates in more detail an example of circuit arrangement of the standard voltage generating circuit 36. The standard voltage generating circuit 36 is provided with resistive divider circuits 361 (first standard voltage generating section) and 362 (second standard voltage generating section), each of which include resistance generating circuit (hereinafter, simply referred to as resistors) $R_0$ to $R_7$ connected in series. To begin with, explained is the resistive divider circuit 361 for generating the standard voltage in accordance with the reference voltage VR of positive polarity supplied from the liquid crystal driving power source 15.

Figure 15:
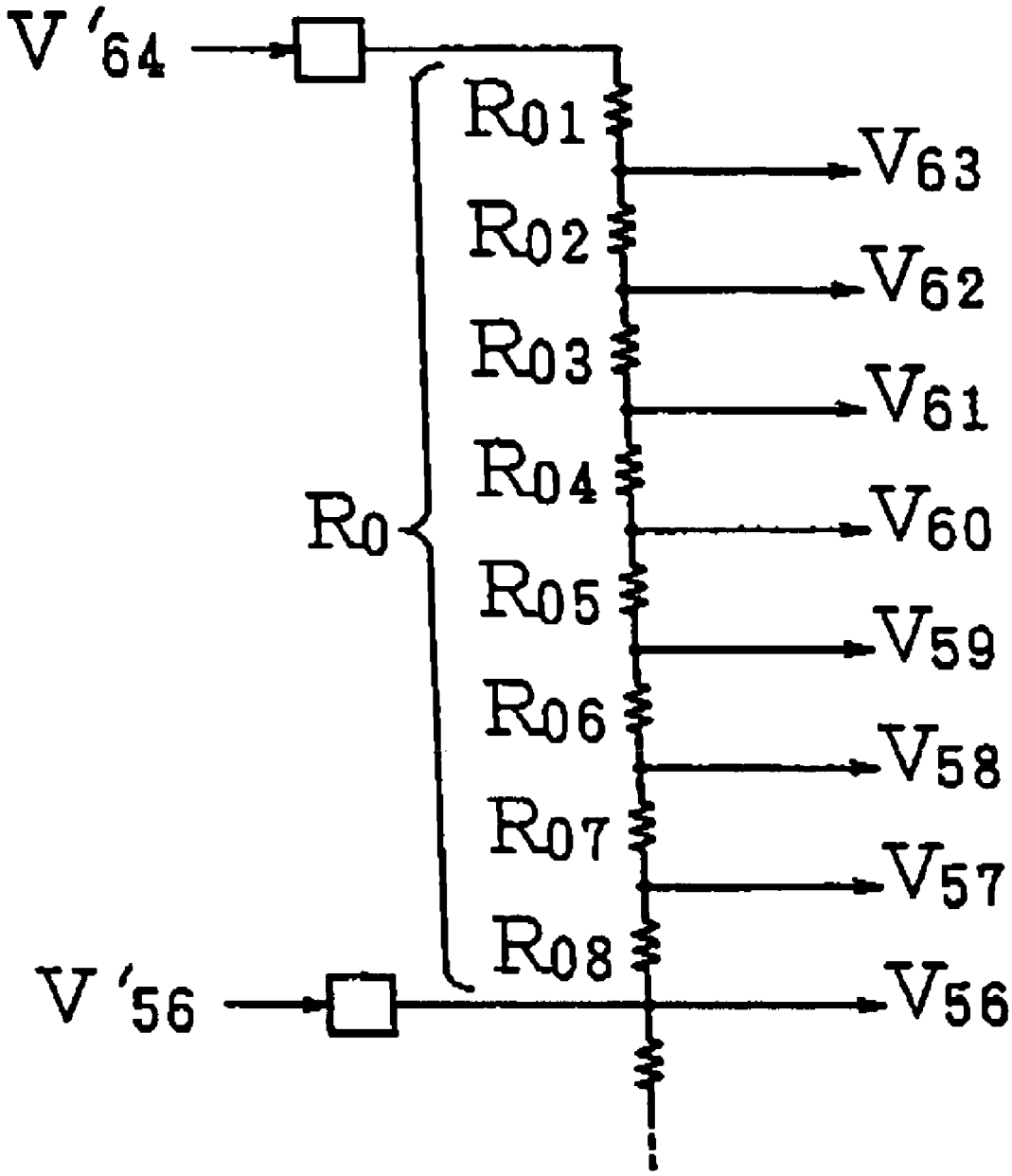
FIG. 15 (CONVENTIONAL ART)
FIG. 15 is a circuit diagram illustrating a resistive divider circuit provided in the standard voltage generating circuit.
Figure 16:
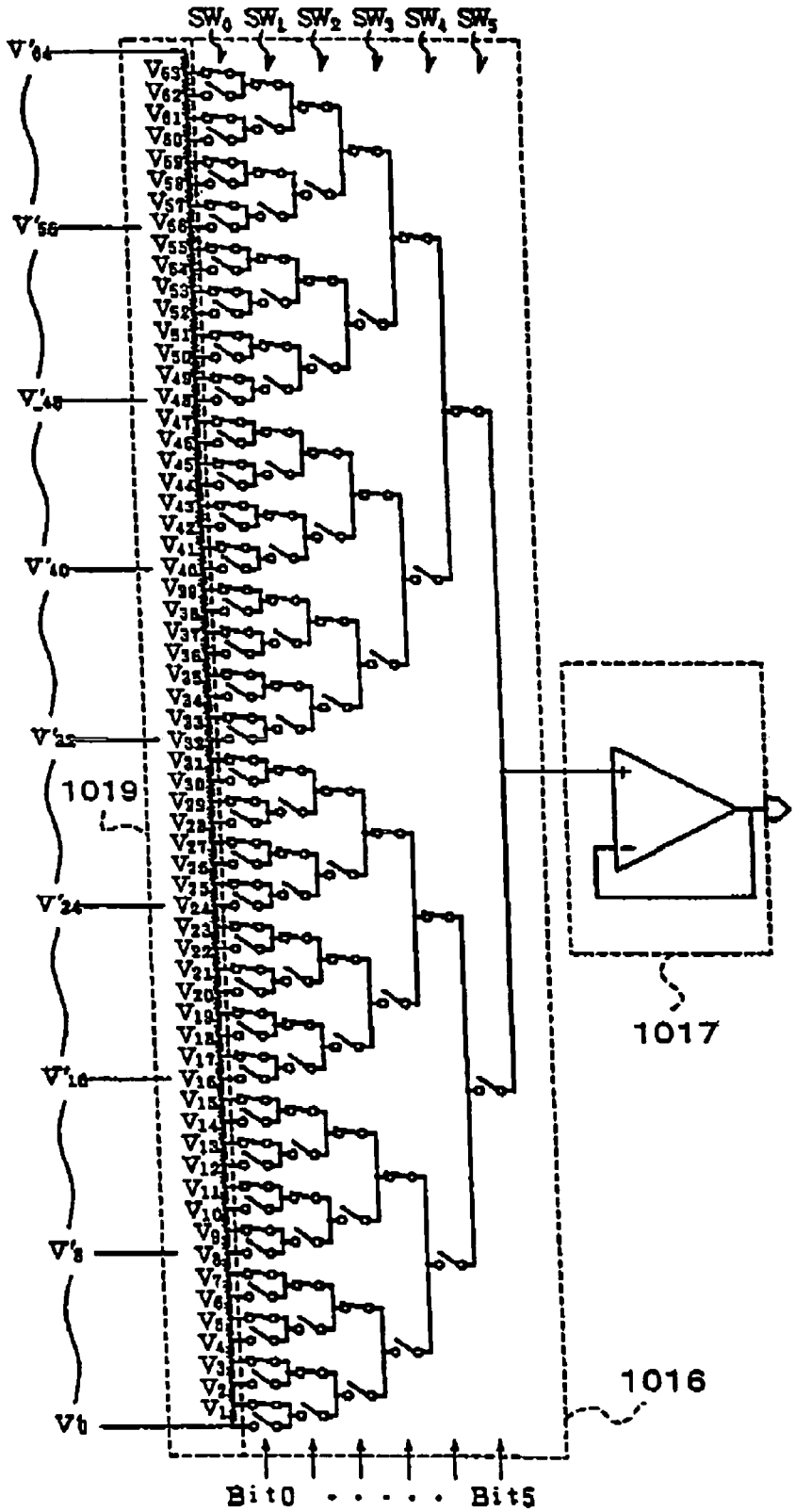
FIG. 16 (CONVENTIONAL ART)
FIG. 16 is a circuit diagram illustrating an arrangement of the standard voltage generating circuit, a D/A converting circuit, and an output circuit.
Figure 17:
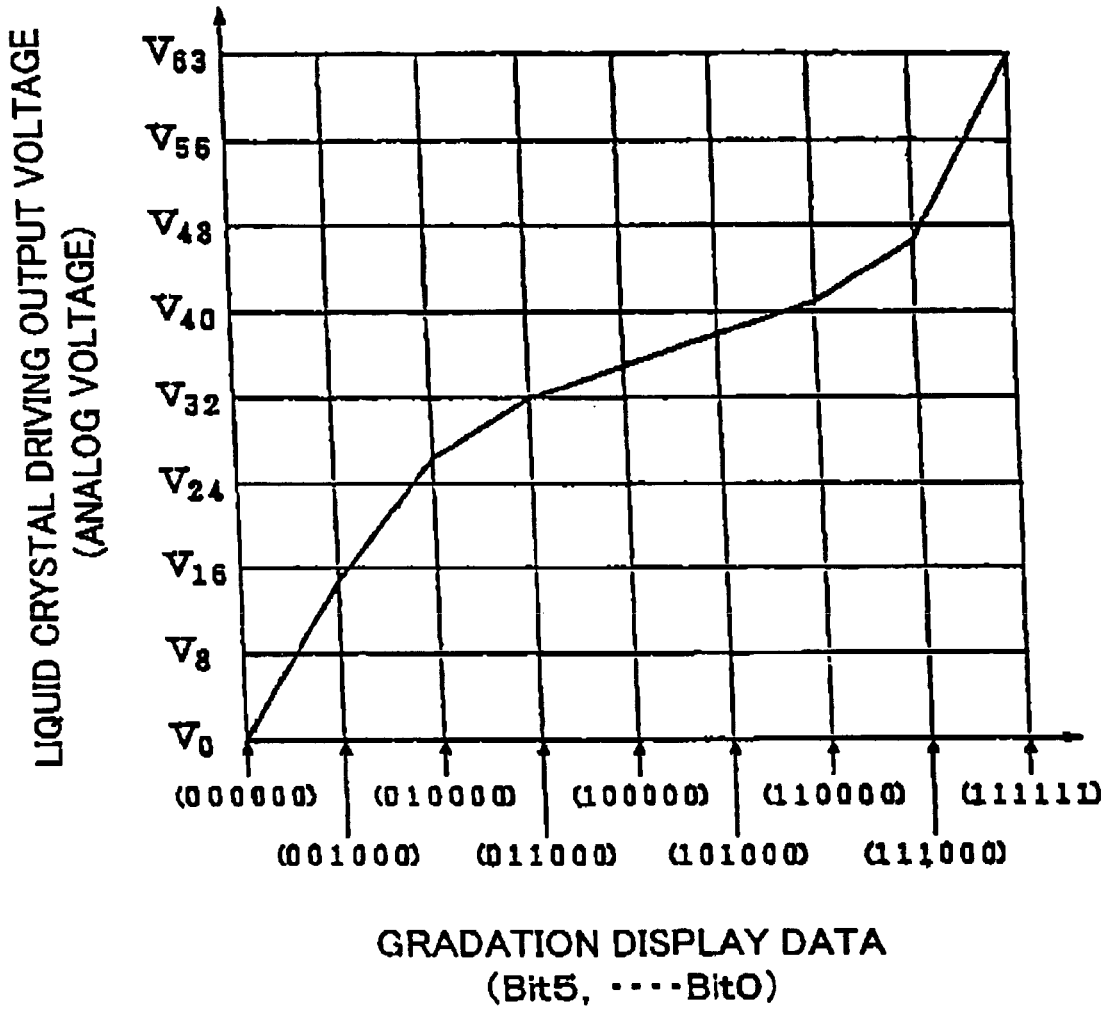
FIG. 17 (CONVENTIONAL ART)
FIG. 17 is a graph showing a relationship between gradation display data and a liquid crystal driving output voltage in case where Y correction is carried out.

Each of the resistors R0 to $R_7$ in the resistive divider circuit 361 has such an arrangement in which eight resistance elements are connected in series. Here, the resistor $R_0$ is explained for example. The resistor $R_0$ is constituted by connecting eight resistance elements $R_{01}$, $R_{02}$, . . . , and $R_{08}$ in series, as the prior art shown in FIG. 15. Moreover, the other resistors $R_1$ to $R_7$ also have the same arrangement as $R_0$. Therefore, the resistive divider circuit 361 is provided with sixty-four resistance elements in total, which are connected in series.

Moreover, the resistive divider circuit 361 includes nine intermediate level voltage input terminals for nine levels of reference voltages $V'_0$, $V'_8$, . . . $V'_{56}$, and $V'_{64}$, for the positive polarity. The nine intermediate tone voltage input terminals receive the nine levels of reference voltages $V'_0$, $V'_8$, . . . $V'_{56}$, and $V'_{64}$, respectively. Specifically, one end of the resistor R0 is connected to the intermediate level voltage input terminal for the reference voltage $V'_{64}$. Meanwhile, the other end of the resistor $R_0$, that is, a node between the resistor R0 and the resistor $R_1$ is connected to the intermediate level voltage input terminal for the reference voltage $V'_{56}$.

Likewise, the intermediate level voltage input terminals for the reference voltages $V'_{48}$, $V'_{40}$, . . . , and $V'_8$, are respectively connected to nodes between the neighboring resistors $R_1$ and $R_2$, $R_2$ and $R_3$, . . . , and $R_6$ and $R_7$. Further, the intermediate level voltage input terminal for the reference voltage $V'_0$, is connected to a node of the resistor R7 via an analog switch SA, the node being on an opposite side of a node between the resistors $R_7$ and $R_6$.

With this arrangement, it is possible to draw out the voltages $+V_1$ to $+V_{63}$ from the neighboring pairs of sixty-four resistance elements. Therefore, in total, sixty-four levels of analog voltages for gradation display used in positive polarity, that is, the standard voltages $+V_0$ to $+V_{63}$, can be obtained by summing up the voltages $+V_1$ to $+V_{63}$ and a voltage $+V_0$ obtained from the reference voltage $V'_0$ without any treatment.

Next, the resistive divider circuit 362 for generating the standard voltage in accordance with a reference voltage VR of negative polarity from the liquid crystal driving power source 15.

As the resistive divider circuit 361, the resistors R0 to $R_7$ in the resistive divider circuit 362 are constituted of eight resistance elements connected in series. Here, the resistor $R_0$ is explained for example. The resistor $R_0$ is constituted by connecting eight resistance elements $R_{01}$, $R_{02}$, . . . , and $R_{08}$ in series. Moreover, the other resistors $R_1$ to $R_7$ also have the same arrangement as $R_0$. Therefore, the resistive divider circuit 362 is provided with sixty-four resistance elements in total, which are connected in series.

Moreover, the resistive divider circuit 362 includes nine intermediate level voltage input terminals for nine levels of reference voltages $V'_0$, $V'_8$, $V'_{56}$, and $V'_{64}$, for the negative polarity. The nine intermediate tone voltage input terminals receive the nine levels of reference voltages $V'_0$, $V'_8$, $V'_{56}$, and $V'_{64}$, respectively.

In general, the reference voltages $V'_0$ and $V'_{64}$, which are the two extremes voltages among the reference voltages $V'_0$ and $V'_{64}$, are always inputted into the intermediate level voltage input terminals. Meanwhile, the seven intermediate level voltage input terminals for the rest, that is, the voltages $V'_8$ to $V'_{56}$, are used for fine adjustment. Thus, in reality, the voltages $V'_8$ to $V'_{56}$ may not be inputted in those intermediate level voltage input terminals therefor.

Note that, the reference voltages $V'_0$, $V'_8$, . . . ,$V'_{56}$, and $V'_{64}$ at the time when the polarity is positive have different values from those at the time when the polarity is negative. For example, in the arrangement shown in FIG. 6, the reference voltages $V'_0$ to $V'_{56}$ at the time when the polarity is positive, correspond to the standard voltages $+V_0$ to $+V_{56}$ respectively (there is not standard voltage that corresponds to the reference voltage $V'_{64}$). Meanwhile, the reference voltages $V'_0$ to $V'_{56}$ at the time when the polarity is negative, correspond to the standard voltages $-V_{56}$ to $-V_0$ respectively (there is not standard voltage that corresponds to the reference voltage $V'_0$). Moreover, the standard voltages $+V_0$ to $+V_{63}$ of positive polarity and the standard voltages $-V_0$ to $-V_{63}$ of negative polarity are respectively equal to their counterparts in terms of absolute values but different in polarity.

One end of the resistor $R_0$ is connected, via an analog switch SB, to a node of the intermediate level voltage input terminal for the reference voltage V'64. Meanwhile, the other end of the resistor $R_0$, that is, a node between the resistors $R_0$ and $R_1$ is connected to the intermediate level voltage input terminal for the reference voltage $V'_{56}$.

Likewise, the intermediate level voltage input terminals for the reference voltages $V'_{48}$ to $V'_8$, are respectively connected to nodes between the neighboring resistors $R_1$ and $R_2$, $R_2$ and $R_3$, . . . , and $R_6$ and $R_7$. Further, a node of the resistor $R_7$, which is on the opposite side of the node between the resistors $R_6$ and $R_7$, is connected to the intermediate level voltage input terminal for the reference voltage $V'_0$.

With this arrangement, it is possible to draw out the voltages $-V_1$ to $-V_{63}$ from the neighboring pairs of sixty-four resistance elements. Therefore, in total, sixty-four levels of analog voltages for gradation display used in negative polarity, that is the standard voltages $-V_0$ to $-V_{63}$, can be obtained by summing up the voltages $-V_1$ to $-V_{63}$ and a voltage $-V_0$ (the analog voltage for gradation display of inverted polarity) obtained from the reference voltage $V'_{64}$ without any treatment.

In addition, the resistive divider circuits 361 and 362 are switched over in accordance with an input polarity inverting signal PLO so that the resistive divider 361 is operated when the reference voltage of positive polarity is inputted, while the resistive divider 362 is operated when the reference voltage of negative polarity is inputted. In other words, one of the analog switch SA and the analog switch SB is turned ON (is closed), while the other one is turned OFF (is opened), in accordance with which polarity the input polarity inverting signal PLO, a "High" polarity or a "Low" polarity.

Note that the analog switches SA and SB are closed in accordance with a control signal of high level. However, the input polarity inverting signal PLO is inputted into the analog switch SB via an inverter 363. Thus, in the reference voltage generating circuit 36, the analog switch SA is closed (while the analog switch SB is opened) when the input polarity inverting signal PLO is of high level, whereby the reference voltage generating circuit 36 outputs intermediate voltages $+V_0$ to $+V_{63}$ that are used when the polarity is positive. On the contrary, the analog switch SB is closed (while the analog switch SA is opened) when the input polarity inverting signal PLO is of low level, whereby the reference voltage generating circuit 36 outputs intermediate voltages $-V_0$ to $-V_{63}$ that are used when the polarity is positive.

Moreover, in the arrangement shown in FIG. 6, it is also possible to supply a right voltage to the DA converting circuit by operation of the selector circuit, even without the analog switches SA and SB. However, in the above arrangement, it is possible to block a current flowing through between the reference voltages $V'_0$ to $V'_{64}$ by the provision of the analog switches SA and SB.

Figure 7:
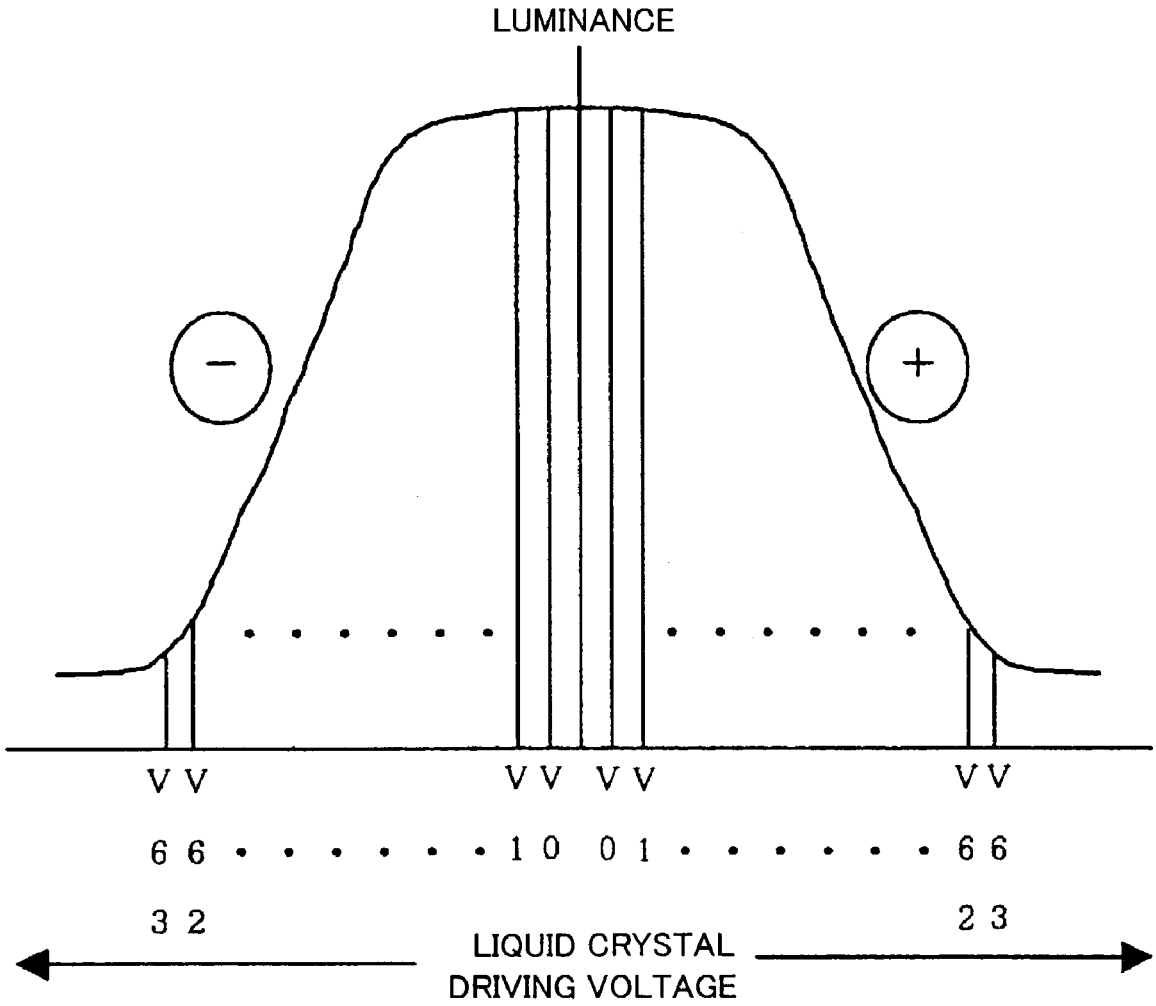
FIG. 7 is a voltage luminance property diagram showing a relationship between a liquid crystal driving voltage and luminance of a TFT liquid crystal.

In FIG. 7, illustrated is an example of relationship between applied voltage and luminance property with respect to a TFT liquid crystal. In FIG. 7, the reference mark "+" indicates driving carried out when the polarity is positive, while the reference mark "−" indicates driving carried out when the polarity is negative. Note that the voltages $V_0$ to $V_{63}$ shown in FIG. 7 relates to the voltages $+V_0$ to $+V_{63}$ and $-V_0$ to $-V_{63}$ as follows. An applied voltage $V_i$ (i=0 to 63) to be applied on the TFT liquid crystal when the polarity is positive is:

$$V_i=[+V_i(\text{Liquid Crystal Driving Voltage})-\text{Potential of Counter Electrode (for example, grounding potential)}].$$

An applied voltage $V_i$ to be applied on the TFT liquid crystal when the polarity is negative is:

$$V_i=[\text{Potential of Counter Electrode (for example, } V'_{64})-V_i(\text{Liquid Crystal Driving Voltage})].$$

Note that the potential of the counter electrode is also switched over in synchronism with the input polarity inverting signal PLO.

Moreover, the standard voltages outputted from the standard voltage generating circuit 36 are divided into two groups in accordance with their voltage values in outputting, and supplied to the selector circuit 39. In the selector circuit 39, the standard voltages belonging to the high standard voltage group (the positive polarity standard voltages $+V_{32}$ to $+V_{63}$, and the negative polarity standard voltages $-V_0$ to $-V_{31}$), are inputted into a selector 391 (see FIG. 8), while the standard voltages belonging to the low standard voltage group (the positive polarity standard voltages $+V_0$ to $+V_{31}$, and the negative polarity standard voltages $-V_{32}$ to $-V_{63}$), are inputted into a selector 392 (see FIG. 8).

Next, the selector circuit 39 is explained referring to FIG. 8. The selector circuit 39 is provided one selector 391 and one selector 392 for each output of the liquid crystal driving voltage output terminal 40. A specific example thereof is explained below.

Firstly, the selector 391 is discussed. Note that the explanation provided here is based on, as an example, a line inversion driving in which the polarity is switched over from the positive polarity to the negative polarity or vice versa for each horizontal line on the display screen (so that each other horizontal line has a different polarity from its neighboring horizontal lines).

Supplied to the selector 391 are the standard voltages $+V_{32}$ to $+V_{63}$ of the standard voltages $+V_0$ to $+V_{63}$ supplied from the resistive divider circuit 361 for the positive polarity, and the standard voltages $-V_0$ to $-V_{31}$ of the standard voltages $-V_0$ to $-V_{63}$ supplied from the resistive divider circuit 362 for the negative polarity. On the other hand, supplied to the selector 392 are the standard voltages $+V_0$ to $+V_{31}$ of the standard voltages $+V_0$ to $+V_{63}$ supplied from the resistive divider circuit 361 for the positive polarity, and the standard voltages $-V_{32}$ to $-V_{63}$ of the standard voltages $-V_0$ to $-V_{63}$ supplied from the resistive divider circuit 362 for the negative polarity. In the selectors 391 and 392, one of the polarities is selected in accordance with the polarity of the input polarity inverting signal PLO.

For example, suppose that, in an odd-numbered horizontal scanning period (that is, a horizontal scanning period carried out in an odd-number time) (in which it is supposed that the input polarity inverting signal PLO is of high level), the positive polarity standard voltages $+V_{32}$ to $+V_{63}$ is selected in the selector 391 while the positive polarity standard voltages $+V_0$ to $+V_{31}$ is selected in the selector 392. In this case, in an even-numbered horizontal scanning period (that is, a horizontal scanning period carried out in an even-number time) (in which it is supposed that the input polarity inverting signal PLO is of low level), the negative polarity standard voltages $-V_0$ to $-V_{31}$ is selected in the selector 391 while the negative polarity standard voltages $-V_{32}$ to $-V_{63}$ is selected in the selector 392.

That is, the standard voltages for the positive polarity are selected in both of the selectors 391 and 392, in accordance with the input polarity inverting signal PLO of high level. On the contrary, the standard voltages for the negative polarity are selected in both of the selectors 391 and 392, in accordance with the input polarity inverting signal PLO of low level. In addition, the selector circuit 39 outputs, to the DA converting circuit 37, which is a next stage for the selector circuit 39, the standard voltages selected by the selectors 391 and 392. Moreover, the selector 391 outputs the high standard voltages while the selector 392 outputs the low standard voltages, regardless of whether the polarity is positive or negative.

Note that the selector circuit 39 is composed of analog switch circuits such as MOS transistors and transmission gates. With this arrangement, the selector circuit 39 switches over the polarities of the standard voltages in accordance with the levels (high/low) of the input polarity inverting signal PLO.

Figure 9:
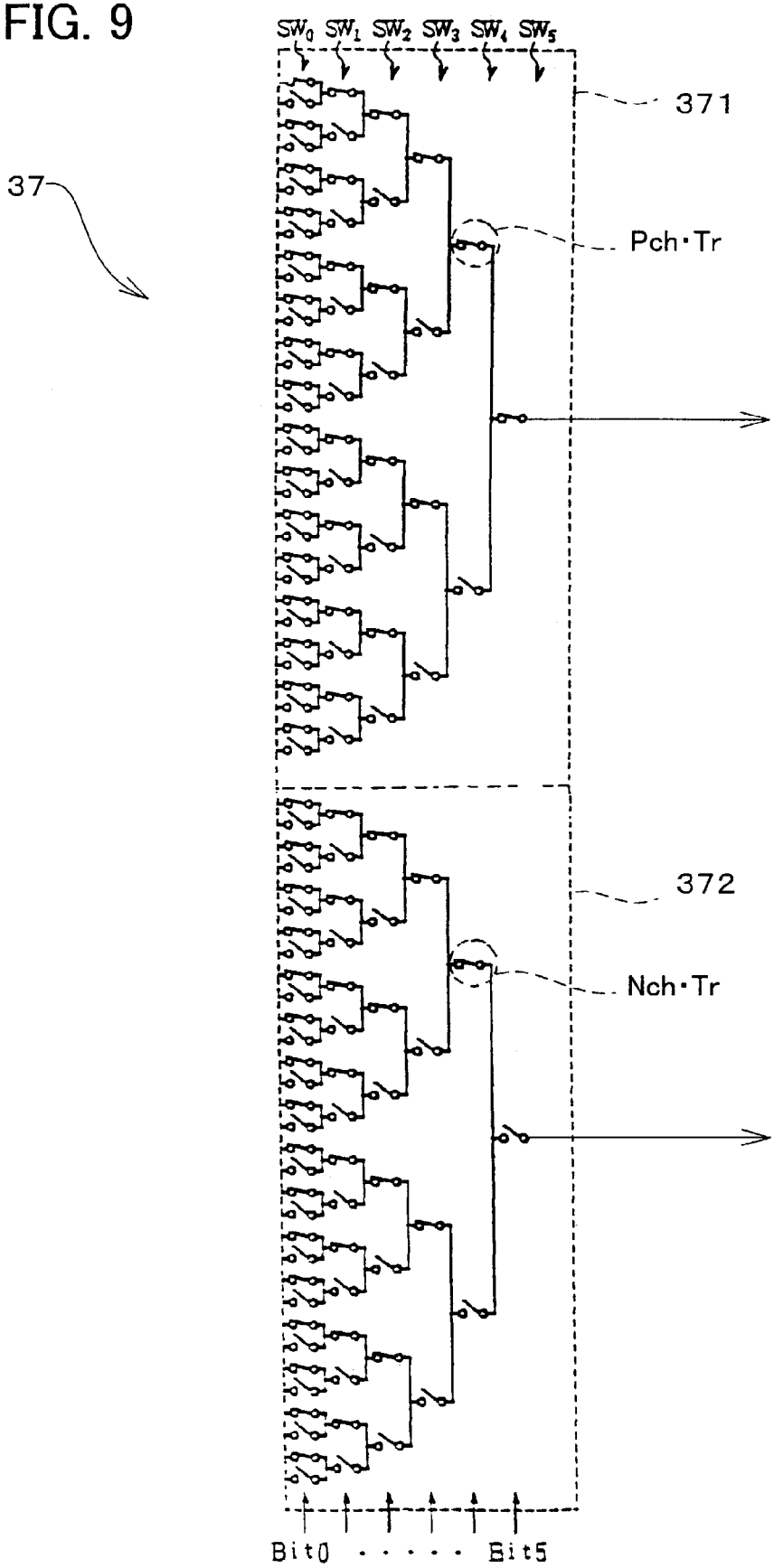
FIG. 9 is a circuit diagram illustrating an arrangement of the D/A converting circuit in the liquid crystal driving apparatus.

With reference to FIGS. 8 and 9, the D/A converting circuit 37 is explained below.

The D/A converting circuit 37 is provided with a D/A converting section 371 (first D/A converting means) and a D/A converting section 372 (second D/A converting means). One converting section 371 and one D/A converting section 372 are provided for each output of the liquid crystal driving voltage output terminals 40. The D/A converting section 371 is a D/A converting section for thirty-two gradations, which is composed of PchMOS transistors. Meanwhile, the D/A converting section 372 is a D/A converting section for thirty-two gradations, which is composed of NchMOS transistors. The aforementioned arrangement allows the D/A converting circuit 37 to perform D/A conversion for sixty-four gradations, by summing up the gradations of the D/A converting sections 371 and 372.

Supplied to the D/A converting section 371 are the high standard voltages from the selector circuit 39, that is, the standard voltages $+V_{32}$ to $+V_{63}$ from the selector 391, or the standard voltages $-V_0$ to $-V_{31}$ from the selector 392. Moreover, supplied to the D/A converting section 372 are the low standard voltages from the selector circuit 39, that is, the standard voltages $+V_0$ to $+V_{31}$ from the selector 391, or the standard voltages $-V_{32}$ to $-V_{63}$ from the selector 392.

As shown in FIG. 9 for example, the D/A converting circuit 37 is provided with MOS transistors or transmission gates as the analog switches, so that in a case where the standard voltages of positive polarity is inputted therein, the D/A converting circuit 37 selects one of the inputted standard voltages $+V_0$ to $+V_{63}$ in sixty-four levels (thirty-two levels for each of the D/A converting sections 371 and 372) in accordance with the display data composed of the digital signals of 6 bits, and outputs the selected one of the inputted standard voltages $+V_0$ to $+V_{63}$. That is, the switches are turned ON/OFF in accordance with each display data (Bit 0 to Bit 5) composed of 6 bits. With this arrangement, one of the inputted voltages of sixty-four levels, and is outputted. The following explains how this is carried out.

Of the digital display data of 6 bits, the Bit 0 is LSB (the least Significant Bit) while the Bit 5 is the MSB (the most Significant Bit). Each two of the switches constitute a switching pair. In each of the D/A converting sections 371 and 372, sixteen switching pairs (thirty-two switches) are for the Bit 0, while eight switching pairs (sixteen switches) are for the Bit 1.

Likewise, a half number of the switching pairs are provided to the next less significant bit. Thus, one switching pair (two switches) is provided to deal with Bit 4. Moreover, one switch is provided to deal with Bit 5. Therefore, each of the D/A converting sections 371 and 372 is provided 32+16+8+4+2+1=sixty three switches (one-hundred-and-twenty-six switches) in total.

Here, the switches for the Bit 0 to Bit 5 are respectively called switch groups SW0 to SW5. Each switch in the switch groups SW0 to SW5 is controlled in accordance with the digital display data (Bit 0 to Bit 5) of 6 bits, as follows. In the switch groups SW0 to SW4, one mate of the pairs of the analog switches (in FIG. 9, the mate of a lower position (hereinafter, referred to as lower switches)) are turned ON when their related Bits are 0 (low level). On the contrary, the other mate of the pairs of the analog switches (in FIG. 9, the mate of an upper position (hereinafter, referred to as upper switches)) when their related Bits are 1 (high level). Moreover, in the switch group SW5, the analog switch of the D/A converting section 372 is turned ON when its related Bit are 0 (low level). On the contrary, the analog switch of the D/A converting section 371 when their related Bits are 1 (high level).

In each D/A converting section 371, one end of each switch for Bit 0 is a terminal for receiving one of the voltages $V_0$ to $V_{63}$. The other end of each switch for Bit 0 is connected that of the mate thereto, and to one end of each switch for Bit 1. Likewise, similar arrangements are repeated until the switches for Bit 5.

In the end, in the D/A converting section 371, the switch for the Bit 5 is turned ON when the Bit 5 is 1 (high level). Thereby, one of the standard voltages $+V_{32}$ to $+V_{63}$ is selectively outputted from the D/A converting section 371 to the output circuit 38. Moreover, in the D/A converting section 372, the switch for the Bit 5 is turned OFF when the Bit 5 is 1 (high level). Thereby, no output is carried out from the D/A converting section 372. On the contrary, the switch for the Bit 5 is turned ON when the Bit 5 is 0 (low level), in the D/A converting section 372. Thereby, one of the standard voltages $+V_0$ to $+V_{31}$ that is selected in accordance with the Bits 0 to 4, is outputted from the D/A converting section 372 to the output circuit 38.

Moreover, the D/A converting circuit 37 operates basically in the same way, even in case the standard voltages of negative polarity are supplied thereto. With this arrangement, the gradation display is realized by selecting that one of the analog voltages $V_0$ to $V_{63}$ for gradation display, that is in accordance with the digital display.

In the D/A converting circuit 37, each switch constituting the D/A converting section 371 is composed of a PchMOS transistor, while each switch constituting the D/A converting section 372 is composed of an NchMOS transistor.

In the other words, in the liquid crystal driving apparatus of the first embodiment, the D/A converting circuit 37 is divided into the two D/A converting sections 371 and 372, which always receive the high standard voltages or the low standard voltages respectively, because of the operation of the selector circuit 39. With this arrangement, it is possible to keep, within an appropriate operating range for one transistor, a voltage between a gate and a source of each MOS transistor constituting the switches in the D/A converting circuit 37.

Because of this, it becomes possible to constitute the switches in the D/A converting circuit 37 of a single transistor, which is either a PchMOS transistor or an NchMOS transistor. Therefore, the number of the transistors to be use is halved in the arrangement, compared with the conventional arrangement where each switch is composed of two transistors in combination. Thus, with aforementioned arrangement, it is possible to give a smaller layout area for the D/A converting circuit 37, thereby contributing to miniaturization of the liquid crystal driving circuit.

Moreover, in the D/A converting sections 371 and 372 in the D/A converting circuit 37, all the switches are constituted of one type of transistors, namely, the PchMOS transistors or the NchMOS transistors. Because of this, it is possible to ignore voltage drop due to the back gate effect in each of the D/A converting sections 371 and 372 by appropriately setting a substrate potential. Thus, it is possible to reduce power consumption in switching in the D/A conversion.

The output from the D/A converting circuit 37 is supplied to the output circuit 38, and then supplied to each output terminal 40 from the output circuit 38. In the arrangement of the first embodiment, the output circuit 38 is provided with a voltage follower circuit whose input stage has a differential pair (for differential input) composed of NchMOS transistors, that is, an operational amplifier 381 (first output means: see FIG. 8), and a voltage follower circuit whose input stage has a differential pair composed of PchMOS transistors, that is, an operational amplifier 382 (second output means: see FIG. 8).

Output from the D/A converting section 371 is supplied to the operational amplifier 381, while output from the D/A converting section 372 is supplied to the operational amplifier 382. Further, output terminals of the operational amplifier 381 and those of the operational amplifier 382 are connected with each other.

Further, each of the operational amplifiers 381 and 382 is provided with a switching-over means for switching over its operation, that is, for turning ON/OFF its operation. In the aforementioned arrangement, one of the operational amplifiers 381 and 382 is operated in accordance with a value of the MSB (Most Significant Bit), while the other is not operated. Thus, it is possible to attain a low power consumption with aforementioned arrangement.

Taking the case of sixty-four gradations as an example, how gradations (0 to 63), the gradation display data (of 6 bits), and the most significant bit (MSB) of gradation-display-use data relate to each other is shown in Table 1.

TABLE 1

| Gradation-display-use data | | | | | | | | |
|---|---|---|---|---|---|---|---|---|
| Binary display | | | | | | | | Most |
| MSB 5 | 4 | 3 | 2 | 1 | LSB 0 | Hexadecimal display | Gradations | Significant Bit |
| 0 | 0 | 0 | 0 | 0 | 0 | 0 0 H | 0 | 0 |
| 0 | 0 | 0 | 0 | 0 | 1 | 0 1 H | 1 | 0 |
| 0 | 0 | 0 | 0 | 1 | 0 | 0 2 H | 2 | 0 |
| . | . | . | . | . | . | . | . | . |
| . | . | . | . | . | . | . | . | . |
| . | . | . | . | . | . | . | . | . |
| 0 | 1 | 1 | 1 | 0 | 1 | 1 D H | 29 | 0 |
| 0 | 1 | 1 | 1 | 1 | 0 | 1 E H | 30 | 0 |
| 0 | 1 | 1 | 1 | 1 | 1 | 1 F H | 31 | 0 |
| 1 | 0 | 0 | 0 | 0 | 0 | 2 0 H | 32 | 1 |
| 1 | 0 | 0 | 0 | 0 | 1 | 2 1 H | 33 | 1 |
| 1 | 0 | 0 | 0 | 1 | 0 | 2 2 H | 34 | 1 |
| . | . | . | . | . | . | . | . | . |
| . | . | . | . | . | . | . | . | . |
| . | . | . | . | . | . | . | . | . |
| 1 | 1 | 1 | 1 | 0 | 1 | 3 D H | 61 | 1 |
| 1 | 1 | 1 | 1 | 1 | 0 | 3 E H | 62 | 1 |
| 1 | 1 | 1 | 1 | 1 | 1 | 3 F H | 63 | 1 |

As shown in Table 1, the most significant bit(MSB) of gradation-display-use data is 0 (low level) when the gradation-display-use data is in a range between 00H to 1FH (in hexadecimal notation), while the most significant bit is 1 (high level) when the gradation-display-use data is in a range between 20H to 3FH.

Because of this, the operational amplifier 382 is operated when the gradation-display-use data is one of voltages separated into a lower voltage group, namely, the gradation-display-use data 00H to 1FH. In this case, the operational amplifier 381 is inactivated (not operated). The operational amplifier 381 is operated when the gradation-display-use data is one of voltages separated into a higher voltage group, namely, the gradation-display-use data 20H to 3FH. In this case, the operational amplifier 382 is inactivated (not operated).

Figure 10:
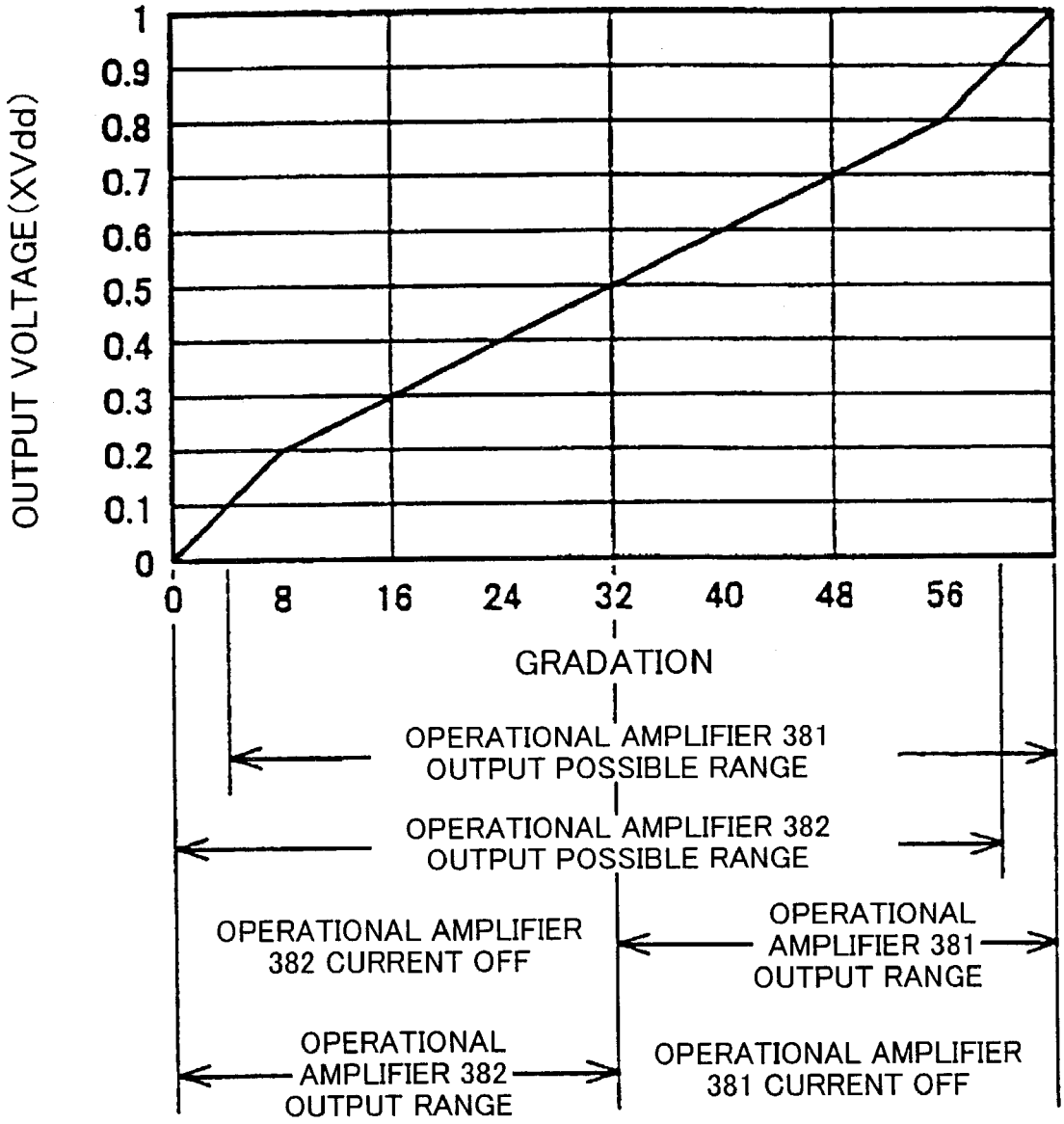
FIG. 10 is a graph illustrating properties of a liquid crystal driving output voltage and a gradation, and relationship between the property and an output possible range of the output circuit.

Here, in FIG. 10, illustrated is a case where a liquid driving output voltage for the gradation-display-use data 00H is a lowest voltage, while a liquid driving output voltage for the gradation-display-use data 3FH is a highest voltage.

As shown in FIG. 10, distortion is caused in the output of the operational amplifier 382 when the voltage is high, while distortion is caused in the output of the operational amplifier 381 when the voltage is low. To overcome this problem, both the operational amplifiers are operated at the same time in the prior art, so as to realize input and output operation without distortion.

On the contrary, in the arrangement of the first embodiment, the output circuit 38 operates the operational amplifier 382 for Pch input and stops operational amplifier 381 for Nch input when the voltage is low. Meanwhile, the output circuit 38 operates the operational amplifier 381 for Nch input and stops the operational amplifier 382 for Pch input when the voltage is high. With this arrangement where the operational amplifiers 381 and 382 are used only when the voltage with which the operational amplifiers 381 and 382 can perform proper output is inputted (while the one which can not perform proper output with the voltage is inactivated), it is possible to realize gradation display of high quality without distortion in input and output. Further, because always only one of the operational amplifiers 381 and 382 is used, it is possible to attain low power consumption.

Figure 11:
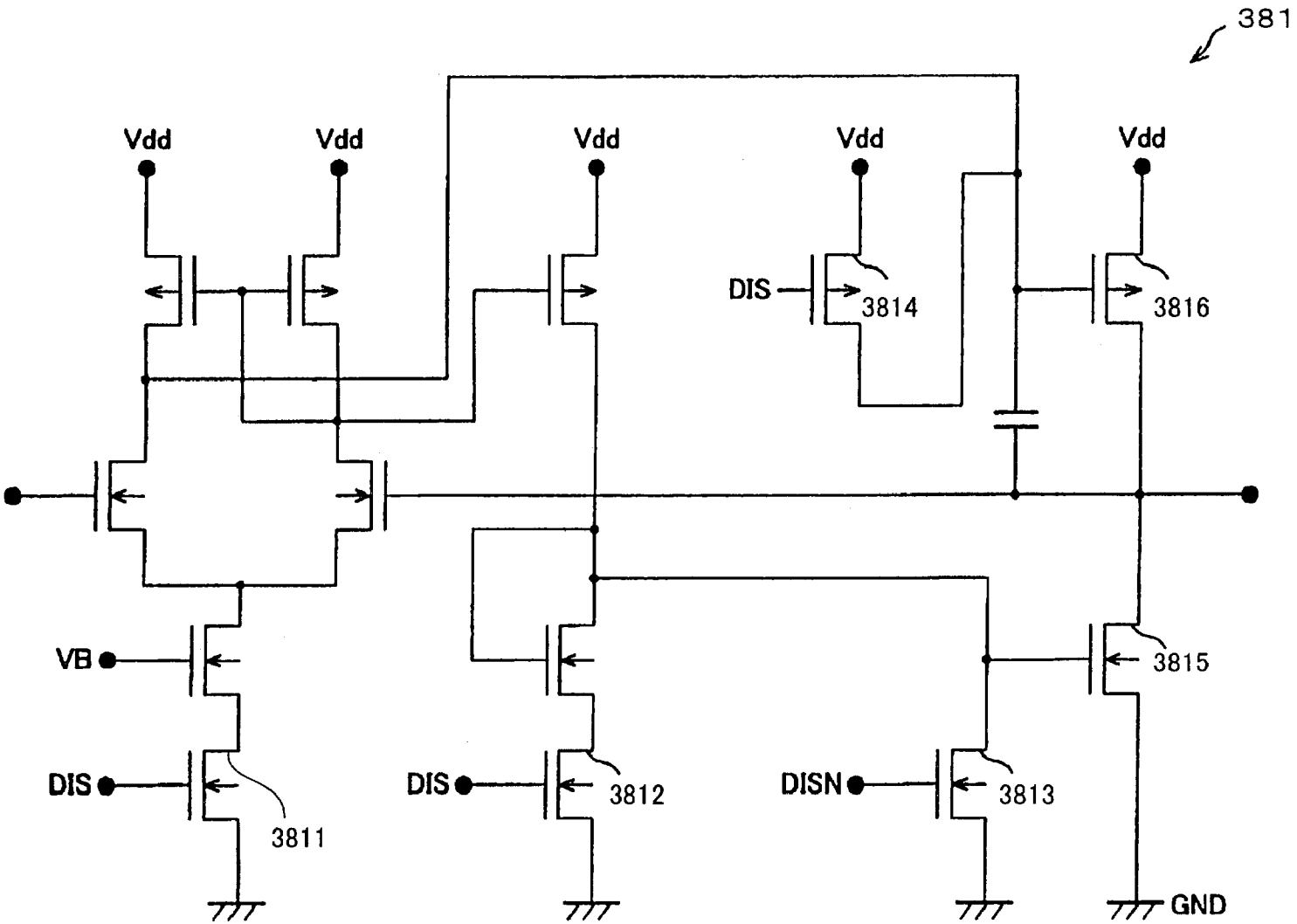
FIG. 11 is a circuit diagram showing an example of differential amplifier circuits in which NchMOS transistors form a differential pair in an input stage thereof.

FIG. 11 illustrates an arrangement of a differential amplifier whose differential pair at input state is composed of NchMOS transistors, as an example of the operational amplifier 381. Moreover, FIG. 12 illustrates an arrangement of a differential amplifier whose differential pair at input state is composed of PchMOS transistors, as an example of the operational amplifier 382.

Figure 12:
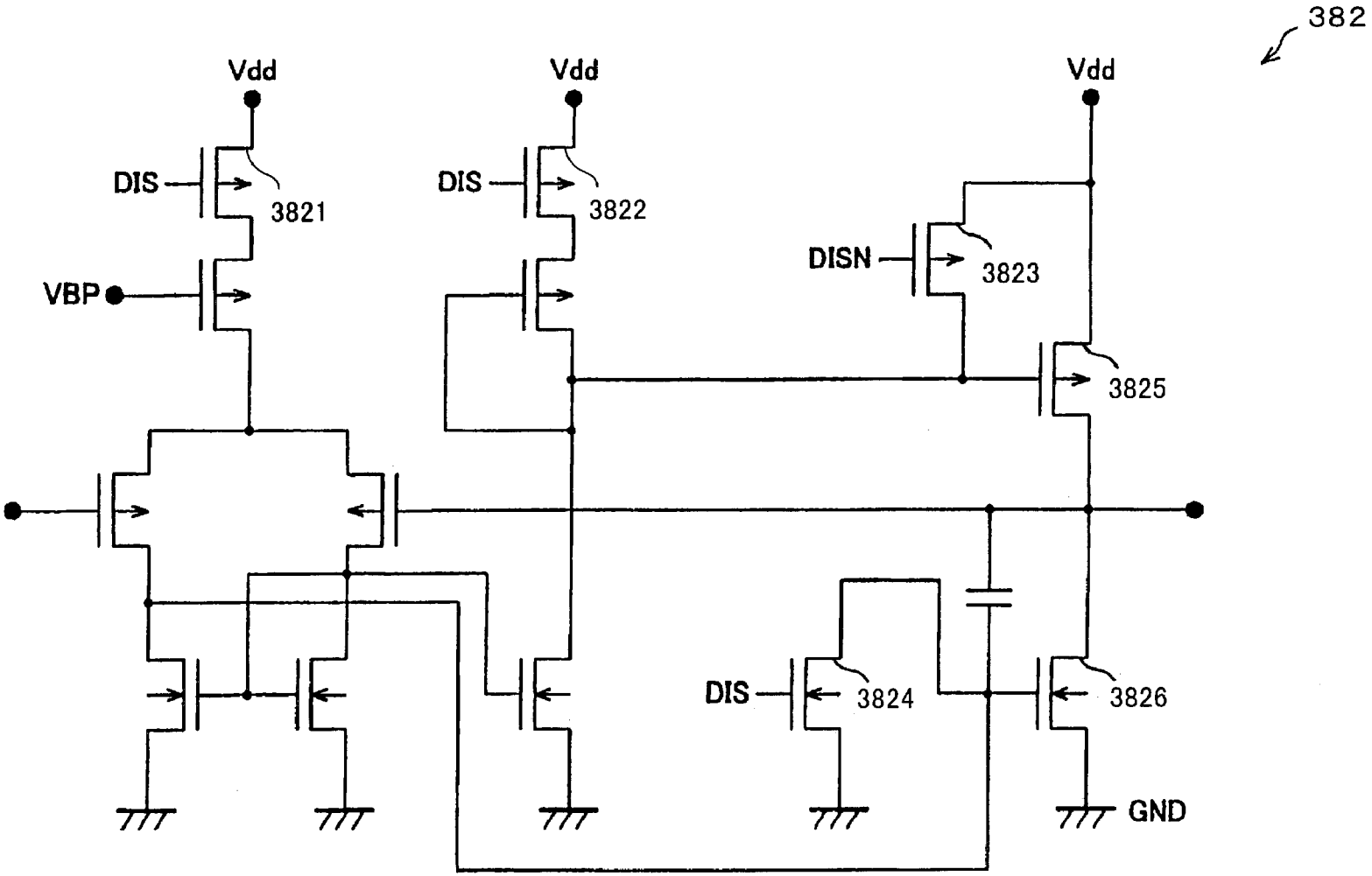
FIG. 12 is a circuit diagram illustrating an example of differential amplifier circuits in which PchMOS transistors form the differential pair in the input stage thereof.
Figure 13:
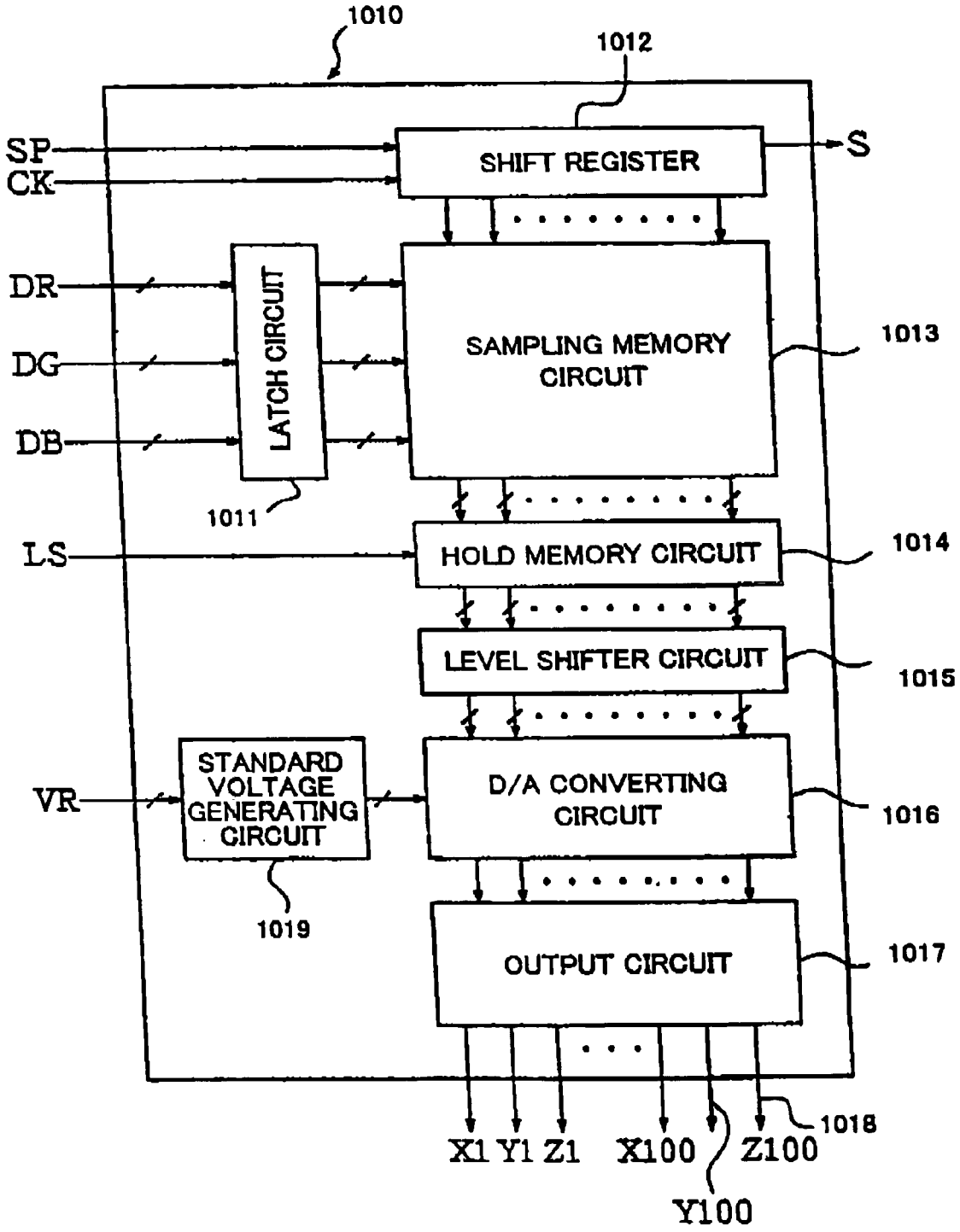
FIG. 13 (CONVENTIONAL ART)
FIG. 13 is a block diagram illustrating an arrangement of a conventional liquid crystal driving apparatus.
Figure 14:
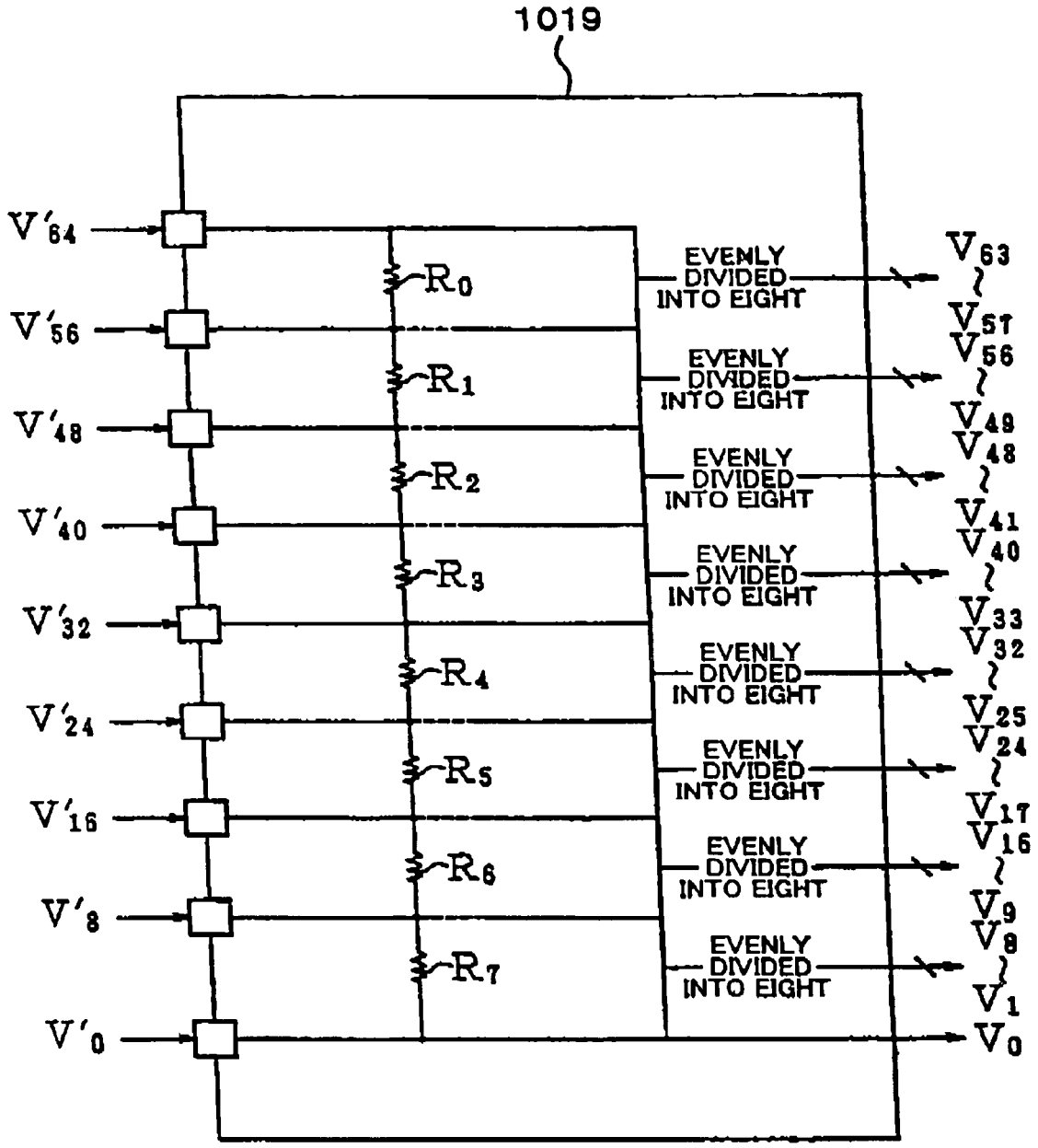
FIG. 14 (CONVENTIONAL ART)
FIG. 14 is a circuit diagram illustrating a standard voltage generating circuit in the conventional liquid crystal driving apparatus.

In FIGS. 11 and 12, a DIS terminal receives the MSB of the display data, while a DISN terminal receives MSB of the display data that has been inverted via an inverter circuit (not shown). Moreover, VB in FIG. 11 and VBP in FIG. 12 indicate voltage input terminals for setting a constant current value flowing through the differential pairs that determine operational point.

In FIG. 11, the MSB of the display data is of high (Vdd level), NchMOS transistors 3811 and 3812 are turned ON, and operating current is supplied thereto. Meanwhile an NchMOS transistor 3813 and a PchMOS transistor 3814 are turned OFF. Thereby, this arrangement operates as a general differential amplifier circuit.

On the contrary, the MSB of the display data is of low (GND level), the NchMOS transistors 3811 and 3812 are turned OFF, and the supply of operating current thereto is stopped. Meanwhile the NchMOS transistor 3813 and PchMOS transistor 3814 are turned ON. This makes an NchMOS transistors 3815 and a PchMOS transistor 3816 at an output stage are turned OFF, that is, output becomes high impedance.

FIG. 12, the MSB of the display data is of low (GND level), PchMOS transistors 3821 and 3822 are turned ON, and operating current is supplied thereto. Meanwhile a PchMOS transistor 3823 and an NchMOS transistor 3824 are turned OFF. Thereby, this arrangement operates as a general differential amplifier circuit.

On the contrary, the MSB of the display data is of High level (Vdd level), the PchMOS transistors 3821 and 3822 are turned OFF, and the supply of operating current thereto is stopped. Meanwhile the PchMOS transistor 3823 and NchMOS transistor 3824 are turned ON. This makes a PchMOS transistors 3825 and an NchMOS transistor 3826 at an output stage are turned OFF, that is, output becomes high impedance.

Therefore, those differential amplifier circuits whose opposite-phase input terminals and output terminals are connect are used as voltage follower circuits.

[Second Embodiment]

Described below is another embodiment, that is, a second embodiment of the present invention.

In the source driver 12, which is the display driving apparatus of the first embodiment, the standard voltage generating circuit 36 receive the reference voltage from the outside at the terminals to receive the highest reference voltage $V'_{64}$, and the lowest reference voltage $V'_0$, so as to generate 64 levels by using the resistive divider circuit. Here, inputted as the reference voltage $V'_{64}$ is a power source voltage Vcc, while GND is inputted as the reference voltage $V'_0$. This make constant the levels of the standard voltages for displaying respective gradations, the standard voltages being outputted from the standard voltage generating circuit 36.

Moreover, in case where the display driving apparatus is adopted in a liquid crystal display apparatus for example, it is necessary to optimize the driving voltage for the liquid crystal panel in accordance with the number of pixels in the liquid crystal panel or types of liquid crystal materials used therein, so as to attain an image display of high quality. Further, it is necessary to generate different levels of the driving voltages for each liquid crystal module.

Moreover, appropriate Y correction is also required for performing the gradation display in the liquid crystal display. The bent-line properties that the liquid crystal driving output voltage should have for performing the Y correction are different depending on the types of the liquid crystal materials, the number of the pixels in the liquid crystal panel, and types of liquid crystal modules Therefore, in desiring the source driver, if it has been decided in designing a source driver how much resistance division ratio the standard voltage generating circuit for gradation display to be mounted on the source driver is to have, it is necessary to design the source driver each time when Y correction property is to be changed in accordance with a type of liquid crystal material of a liquid crystal module to be used or the number of pixels in a liquid crystal panel.

Alternatively, for changing Y correction property in accordance with a type of liquid crystal materials to be used and the number of pixels in a liquid crystal panel in a liquid crystal module, it may to possible to adopt, for example, a method of modulating a plurality of intermediate level voltages by inputting a highest VH and a lowest VL from a standard voltage generating circuit, as does a circuit arrangement described in Japanese Publication of Unexamined Patent Application, Tokukaihei, No. 6-348235 (published on Dec. 22, 1994)

However, with the arrangement of the publication, the provision of a standard voltage modulating means leads to an increase in number of terminals, and an increase in buffer circuits, which has a large power consumption and a large circuit size. This gives a larger chip size to a chip to be manufactured and increases manufacturing cost thereof. Furthermore, power consumption of the chip is increased.

A display driving apparatus of the second embodiment is capable of changing the Y correction property within a range of Y correction value voltages, without increasing the manufacturing cost. Therefore, the liquid crystal display apparatus of the second embodiment is provided with a source driver 17 shown in FIG. 18, instead of the source driver 12 shown in FIG. 1. Note that the liquid crystal display apparatus explained in the second embodiment is arranged in the same way as is the first embodiment, in terms of other liquid crystal panel and in a liquid crystal driving waveform. Therefore, explanation on the other liquid crystal panel and in a liquid crystal driving waveform is omitted here.

Figure 18:
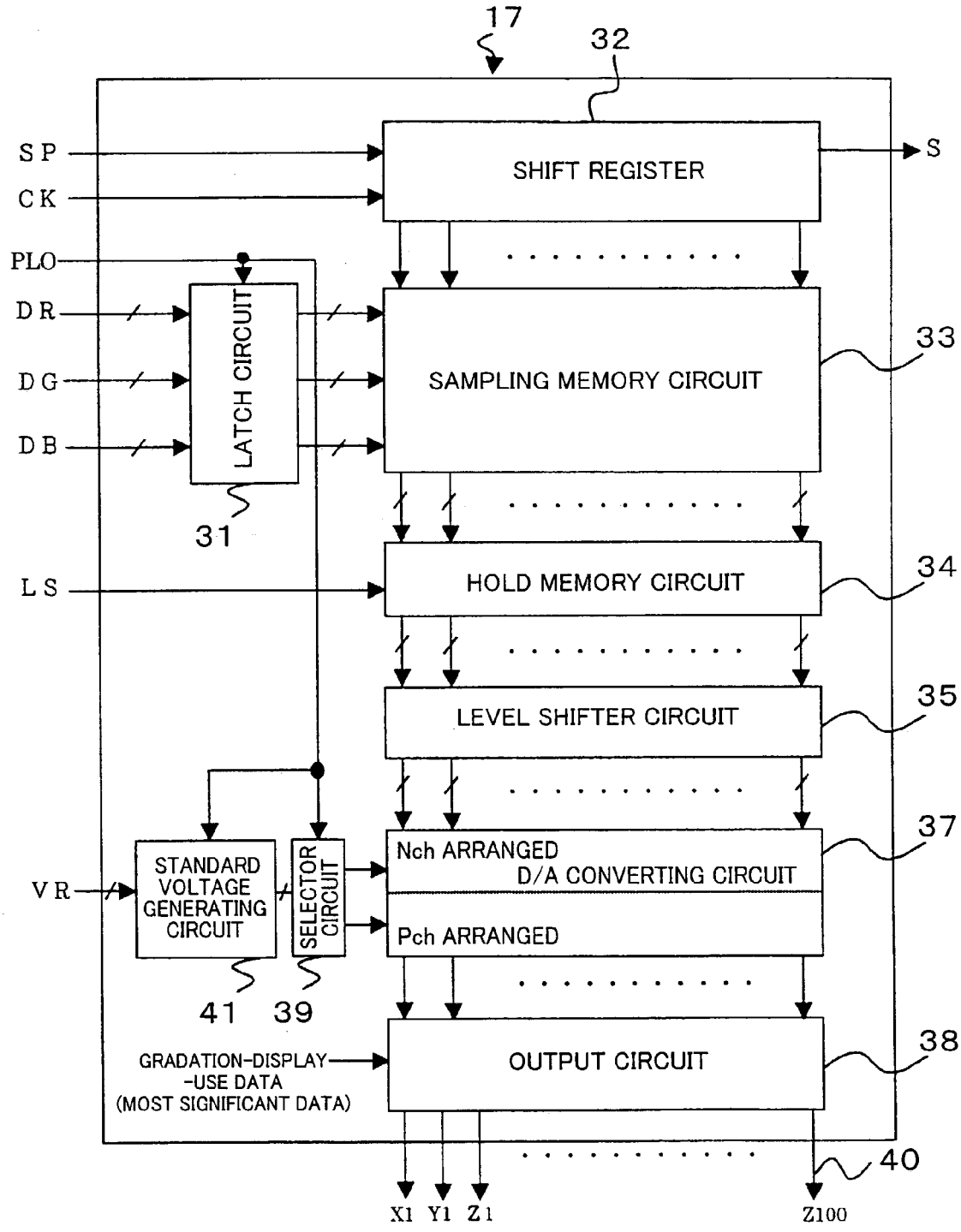
FIG. 18 is a block diagram illustrating an arrangement of a liquid crystal driving apparatus showing another embodiment of the present invention.

FIG. 18 illustrates schematically an arrangement of the source driver 17 as the liquid crystal driving apparatus of the second embodiment. The source driver 17 is provided with an input latch circuit 31, a shift register circuit 32, a sampling memory circuit 33, a hold memory circuit 34, a level shifter circuit 35, a standard voltage generating circuit 41, a D/A converting circuit 37, an output circuit 38, and a selector circuit 39 (separating means). The source driver 17 has the same arrangement as the source driver 12 in the first embodiment, except the standard voltage generating circuit 41. Thus, no detailed explanation on the source driver 17 is provided here.

Figure 19:
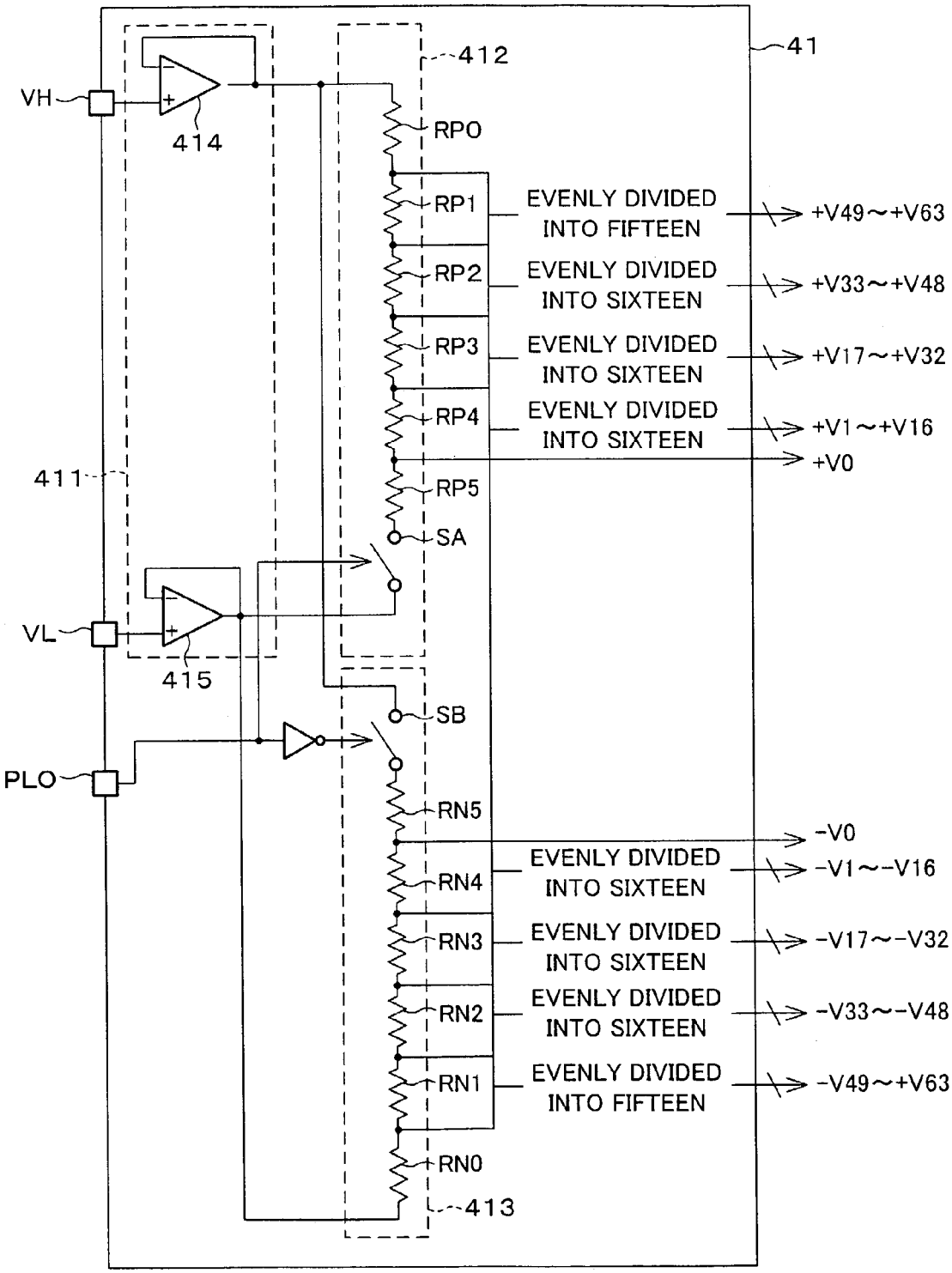
FIG. 19 is a circuit diagram of an arrangement of a standard voltage generating circuit in the liquid crystal driving apparatus.

The standard voltage generating circuit 41 is, as shown in FIG. 19, provided with an adjustment-use amplifier 411, and two resistive divider circuits 412 (first standard voltage generating section) and 413 (second standard voltage generating section). The adjustment-use amplifier 411 adjusts the Y correction value for the resistive divider circuits 412 and 413. The resistive divider circuits 412 and 413 are provided so as to enable the standard voltage generating circuit 41 to deal with AC driving of positive polarity and that of negative polarity. The resistive divider circuits 412 and 413 generate various analog voltages of positive polarity and that of negative polarity for gradation display, respectively.

Note that the two resistive divider circuits 412 and 413 are arranged such that one of the two resistive divider circuits 412 and 413 is selected in accordance with polarity of an input polarity inverting signal PLO supplied from a controller 14, so that a standard voltage of positive polarity or of negative polarity is generated by using the selected one of the two resistive divider circuits 412 and 413.

The resistive divider circuit 412, which is for the positive polarity, is provided with resistors RP0 to RP5, and an analog switch SA. With the resistors RP0 to RP5, a resistive ratio for performing the Y correction as a standard is generated. The analog switch SA is controlled in accordance with the input polarity inverting signal PLO. The resistors RP0 to RP5 are usually made of a highly resistive polysilicon.

A highest voltage input terminal VH is connected, via a first buffer amplifier 414 of the adjustment-use amplifier 411 to one of nodes of the resistor RP0, among the resistors RP0 to RP5. To the other node of the resistor RP0 is connected to the resistor RP1.

Each of the resistance elements RP1 to RP4 is constituted by connecting a plurality of resistance elements in series. For example, the resistor RP1 is constituted of fifteen resistance elements connected in series, even if the fifteen resistance elements are not shown in FIG. 19. Moreover, the other resistors RP2 to RP4 are also constituted of sixteen resistance elements connected in series.

One end of the resistor RP5 is connected with the resistor RP4, while the other end of the resistor RP5 is connected to, via the analog switch SA, an output terminal of a second buffer amplifier 415 of the adjustment-use amplifier 411 to which the lowest voltage input terminal VL is connected.

Therefore, in the resistors RP0 to RP5, sixty-five resistance elements are connected in series in total.

On the other hand, the resistive divider circuit 413, which is for the negative polarity, is provided with resistors RN0 to RN5, and an analog switch SB. With the resistors RN0 to RN5, a resistive ratio for performing the Y correction as a standard is generated. The analog switch SB is controlled in accordance with the input polarity inverting signal PLO. The resistors RN0 to RN5 are usually made of a highly resistive polysilicon.

A lowest voltage input terminal VL is connected, via the second buffer amplifier 415 of the adjustment-use amplifier 411 to one of nodes of the resistor RN0, among the resistors RN0 to RN5. To the other node of the resistor RN0 is connected to the resistor RN1.

Each of the resistance elements RN1 to RN4 is constituted by connecting a plurality of resistance elements in series. For example, the resistor RN1 is constituted of fifteen resistance elements connected in series, even if the fifteen resistance elements are not shown in FIG. 19. Moreover, the other resistors RN2 to RN4 are also constituted of sixteen resistance elements connected in series.

One end of the resistor RN5 is connected with the resistor RN4, while the other end of the resistor RP5 is connected, via the analog switch SB to an output terminal of the first buffer amplifier 414 of the adjustment-use amplifier 411, to which the lowest voltage input terminal is connected.

Therefore, in the resistors RN0 to RN5, sixty-five resistance elements are connected in series in total.

Next, a specific example of operation of the standard voltage generating circuit 41 is explained below.

The standard voltage generating circuit 41 receives two types of voltages, namely, the highest reference voltage VH and the lowest reference voltage VL. The highest reference voltage VH and the lowest reference voltage VL are inputted via two voltage input terminals VH and VL. In the prior art and the first embodiment, the standard voltage generating circuit receives the power source voltage and the GND voltage, as the highest and lowest reference voltages to be inputted therein. On the contrary, the standard voltage generating circuit 41 of the second embodiment is capable of receiving arbitral DC voltages as the highest reference voltage VH and the lowest reference voltage VL thereof.

As described above, the bent line properties of the liquid crystal driving output voltage for the Y correction are different depending on the types of the liquid crystal materials and the number of the pixels in the liquid crystal panel. However, as long as a gradation value is the same, one bent-line property has the same voltage ratio between gradations. Thus, it is theoretically possible to attain a desired Y correction by modulating values of the voltages to be inputted into the highest voltage input terminal VH and the lowest voltage input terminal VL of the standard voltage generating circuit. Specifically, it is possible to easily adjust bias values (gradation-display-use analog voltage value) in the resistive divider circuits 412 and 413, by inputting DC voltages having arbitral values respectively into the highest voltage input terminal VH and the lowest voltage input terminal VL.

In reality, however, it is important to have stability in each level of the analog voltages for gradation display, because liquid crystal display loads (pixels) are capacitive loads. For this reason, the voltages to be inputted through the highest voltage input terminal VH and the lowest voltage input terminal VL are respectively supplied, via the first or second buffer amplifier in the adjustment-use amplifier 411, to the resistors that are for receiving the highest voltage and the lowest voltage, respectively. In this ways, low impedance conversion of the inputted voltages is carried out so as to eliminate fluctuation in voltage in charging or discharging the capacitive loads, thereby realizing the stability in the analog voltage for gradation display.

Moreover, in the aforementioned arrangement, the buffer amplifiers are provided only for the highest input voltage VH and the lowest input voltage VL. Compared with the prior art, the aforementioned arrangement has only two more buffer circuits. This will not cause a significant increase in power consumption in the aforementioned arrangement.

With the arrangement of the second embodiment, as described above, it is possible to generate and adjust the intermediate voltages in the standard voltage generating circuit for gradation display, without a need of the nine levels of the reference voltages V'0, V'8, . . . , V'56, and V'64 as in the conventional standard voltage generating circuit 1019.

Moreover, the adjustment-use amplifier 411 connected to the highest voltage input terminal VH and the lowest voltage input terminal VL is capable of increasing resistance values of the resistive divider circuits 412 and 413, thereby suppressing current values of the currents flowing through the resistive divider circuits 412 and 413.

Moreover, unlike the prior art, the power source voltage and the GND voltage are not inputted into the highest voltage input terminal VH and the lowest voltage input terminal VL in the aforementioned arrangement. Thus, because of the provision of the buffer amplifiers in the standard voltage generating circuit 41, it is possible to allow an exterior voltage generating means to have a small output impedance, thereby alleviating load on an output stage of the exterior voltage generating means.

Note that one of the resistive divider circuits 412 and 413 are selected in accordance with which polarity the input polarity inverting signal PLO, a "High" polarity or a "Low" polarity, and the selected one of the resistive divider circuits 412 and 413 operates. The input polarity inverting signal PLO is supplied from a polarity inverting terminal PLO of a liquid crystal driving output. In other words, one of the analog switches SA and the analog switch SB, provided in the resistive divider circuit 412 or 413 is turned ON (is rendered conducting), while the other one is turned OFF (is rendered non-conducting), in accordance with which polarity the input polarity inverting signal PLO, a "High" polarity or a "Low" polarity. Thus, both the resistive divider circuits 412 and 413 are not rendered non-conducting during the operation. Here, suppose that the analog switches SA and SB are closed when the applied voltage "High" is applied on a gate of the analog switches.

The standard voltages outputted from the standard voltage generating circuit 41 are divided into two groups in terms of whether their voltages values are high or low in outputting. The thus grouped standard voltages are inputted into the selector circuit 39. The selector circuit 39, D/A converting circuit 37, and the output circuit 38 have the same arrangement and operate in the same way as in the source driver 12 described in the first embodiment. Thus, their detailed explanation is omitted here.

The display driving apparatus of the second embodiment is characterized in that the display driving apparatus is capable of easily modulating the Y correction value with in a range of the Y correction value voltages in accordance with the reference standard voltages supplied from outside. However, it is expected that the standard voltage from the power source circuit should be newly generated for some of liquid crystal module.

Figure 20:
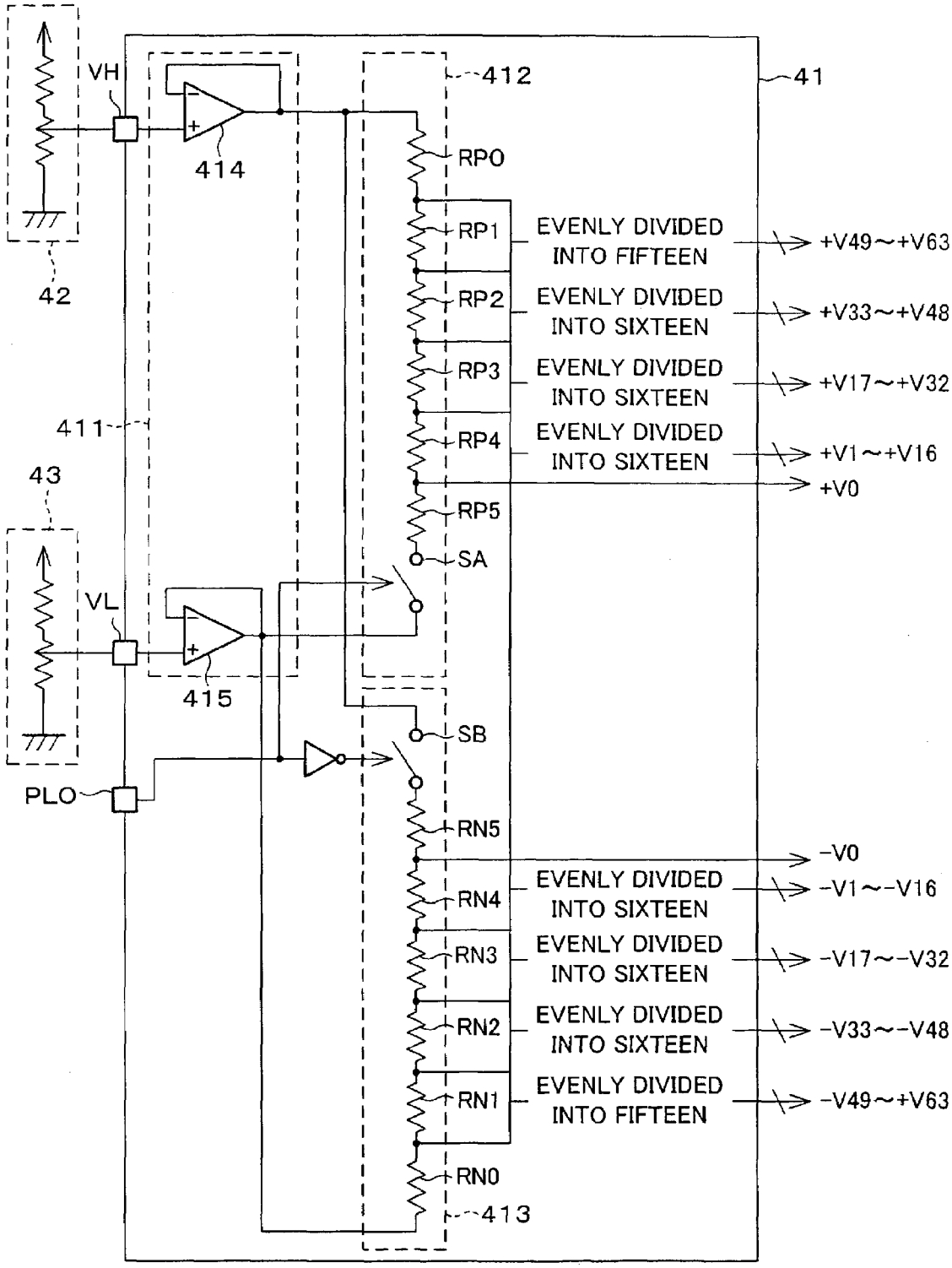
FIG. 20 is a circuit diagram of an arrangement of another standard voltage generating circuit in the liquid crystal driving apparatus.

To meet this necessity, it is also possible to arrange that, as shown in FIG. 20, modulators 42 and 43 (for example, electronic modulators) for modulating the standard voltages are externally provided to the highest voltage input terminal VH and the lowest voltage terminal VL outside of the standard voltage generating circuit 41. With the above arrangement, it is possible to easily adjust the Y correction values without newly designing the power source circuit for the standard voltage generating circuit 41.

Figure 21:
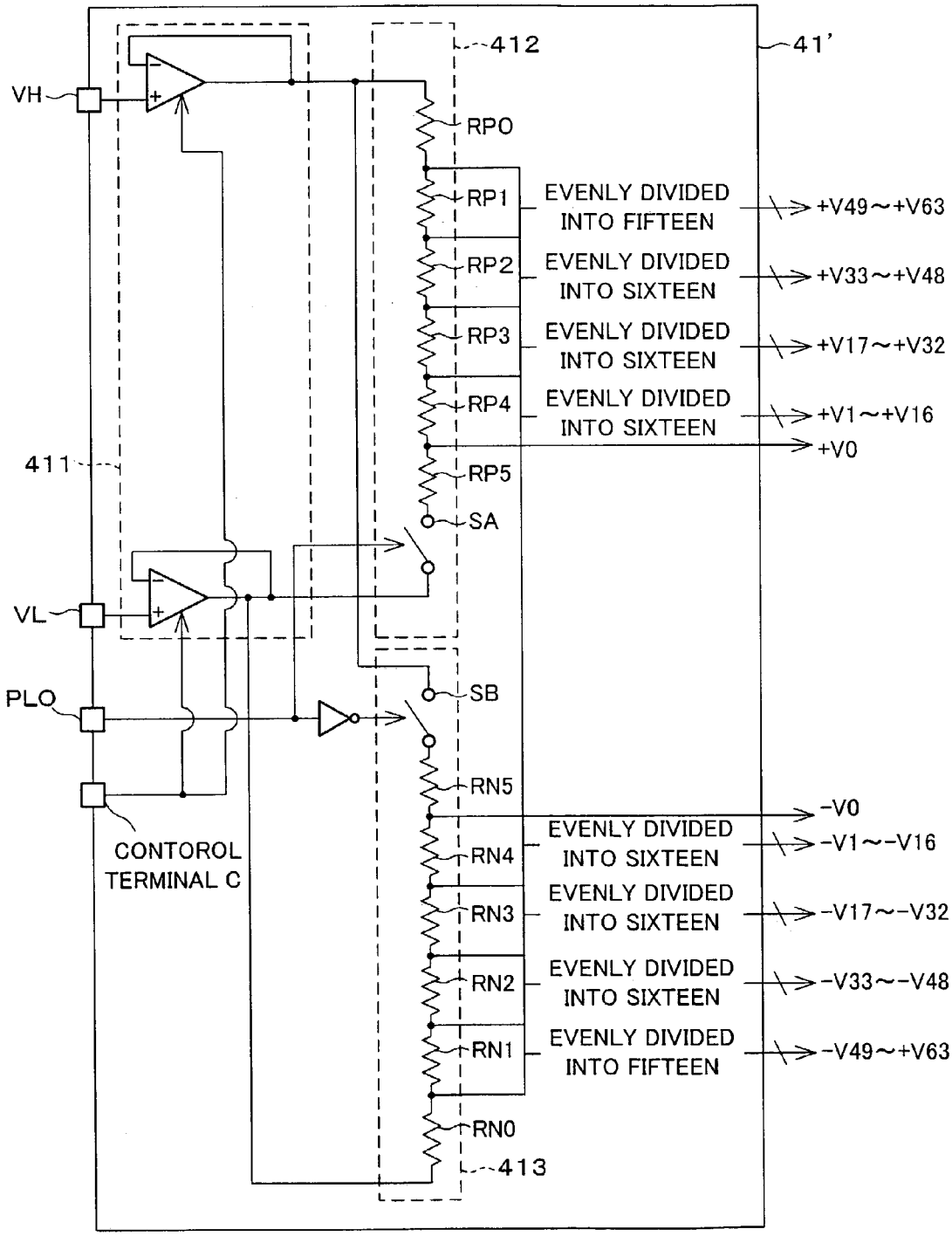
FIG. 21 is a circuit diagram of an arrangement of still another standard voltage generating circuit in the liquid crystal driving apparatus.

Moreover, it is also possible to have an arrangement shown in FIG. 21, in order to attain further lower power consumption in the standard voltage generating circuit 41.

A source driver 41' as a display driving apparatus having the arrangement shown in FIG. 21 is so arranged that first and second buffer amplifiers 414 and 415 are selectively operated and stopped in accordance with a voltage supplied to a control terminal C, the first and second buffer amplifiers being respectively connected to the highest voltage input terminal VH and the lowest voltage input terminal VL in the adjustment-use amplifier 411.

The source driver 41' operates as follows. To being with, an applied voltage "High" is supplied to the control terminal C during one horizontal period, the control terminal C being connected to gates of the analog switches SA and SB. Then, both of the first and second buffer amplifiers 414 and 415 are rendered conducting. Thereby, sixty-four levels of standard voltages for the positive and negative polarity are generated as usual. On the other hand, when an applied voltage "Low" is supplied to the control terminal C, both of the first and second buffer amplifiers 414 and 415 are rendered non-conductive, whereby both the first and second buffer amplifiers 414 and 415 are stopped.

For example, it is preferable to carry out this switching-over of the operation and inactivating of the buffer amplifiers 414 and 415. For example, when charging/discharging of a pixel capacitor is ended after elapse of a predetermined period T1 (T1 is supposed to be within one horizontal period), the operation of the buffer amplifiers 414 and 415 are controlled to stop (the buffer amplifiers 414 and 415 are inactivated) in a vertical synchronizing blanking period in which a control signal for stopping the operation of the buffer amplifiers 414 and 415. Such control leads to lower power consumption in the buffer amplifiers 414 and 415.

Alternatively, for example, in case the liquid display apparatus is applied in a portable apparatus such as a portable telephone and the like, it is also effective to arrange such that the operation of the buffer amplifiers 414 and 415 are controlled to stop when a scanning signal is stopped as a still image is displayed on a screen during a waiting time or the like.

Note that, in the explanation in the first and second embodiments, the arrangements in which the voltage follower circuits are used as the output circuits, as examples. However, it is also possible to adopt a non-inverting differential amplifier circuit or an inverting amplifier circuit as an output circuit, apart from the voltage follower circuit.

In this case, the level shifter circuit 35 shown in FIG. 1 is not necessary because the voltage for gradation display can be amplified by the output circuit. This leads to reduction in the number of circuits. Further, this allows the display driving apparatus to be used for a display apparatus to which a high voltage is applied.

Moreover, discussed in the first and second embodiments are cases in which the line inversion driving method is applied. However, the present invention is not limited to this. Frame inversion or dot inversion driving method in which the inversion is performed per pixel, are also applicable in the present invention. According to the present invention, it is possible to change the switching-over operation in each circuit in accordance with the input polarity inverting signal PLO, in conformity with which inversion method is applied.

Moreover, the driving circuits of the first and second embodiments are explained referring to the case where the driver in the tape carrier package form is mounted in a frame area of the liquid crystal panel. However, the present invention is not limited to this. For example, a bump of a driver IC chip may be directly mounted on an ITO terminal of the liquid crystal panel via ACF, or the circuits may by formed on the liquid crystal panel by using CGS and the like.

Moreover, the driving circuits of the present invention is suitable applicable not only in liquid crystal display apparatus, but also a display apparatus, which includes pixels arranged in matrix, and which realizes gradation display by changing applied voltages, wherein polarities of the applied voltages applied on display elements are inverted in order to secure reliability of the display apparatus. Especially, the driving circuits of the present invention are suitably used in such display apparatus of portable type.

As described above, a display driving apparatus of the present invention for supplying a gradation-use voltage to a data signal line of a display panel of active matrix type, the gradation-use voltage being inverted in polarity in a predetermined polarity inverting cycle, and being adjusted in accordance with display data, the display driving apparatus includes: a standard voltage generating section for generating standard voltages as many as gradations; a separating section for separating, into a high voltage group and a low voltage group, the standard voltages having been generated by the standard voltage generating section; a first D/A (digital-analog) converting section for (a) receiving the standard voltages in the high voltage group, (b) selecting one of the thus inputted standard voltages in the high voltage group by controlling open/close of switches in accordance with the display data, and (c) outputting the thus selected standard voltage as the gradation-display-use voltage; and a second D/A converting section for (d) receiving the standard voltages in the low voltage group, (e) selecting one of the thus inputted standard voltages in the low voltage group by controlling open/close of switches in accordance with the display data, and (f) outputting the thus selected standard voltage as the gradation-display-use voltage.

Moreover, the display driving apparatus may be so arranged that the switches in the first D/A converting section are all PchMOS transistors, and the switches in the second D/A converting section are all NchMOS transistors.

With the above arrangement, the standard voltage generating section generates the standard voltages as many as the gradations required for gradation display. The polarities of the standard voltages are inverted in the predetermined cycle. The standard voltages generated by the standard voltage generating means is separated, by the separating section, into the high voltage group and the low voltage group.

The first D/A converting section selects one of the standard voltages separated into the high voltage group by the separating section, while the second D/A converting section selects one of the standard voltages separated into the low voltage group by the separating section. The thus selected standard voltages are outputted as the gradation-display-use voltage (voltage for gradation display).

In this arrangement, the first D/A converting section always carries out the selection as to the standard voltages in the high voltage group only, even though the gradation-display-use voltage is to be subjected to the inversion of polarity. Therefore, it is possible to compose the first D/A converting section of switches that properly operate for input of high voltages (but cause distortion for input of low voltages), such as a PchMOS transistor and the like.

Likewise, it is possible to compose the second D/A converting section of switches that properly operate for input of low voltages (but cause distortion for input of high voltages), such as an NchMOS transistor and the like.

This eliminates a need of the arrangement in which one switch is composed of two transistor as in the prior art in order to attain proper operation to deal with both the high and low voltages. Thus, this reduces the number of switches (for example, transistors) to be used in D/A conversion, thereby giving a circuit for the D/A conversion a smaller layout area, thus attaining miniaturization of the display driving circuit.

Moreover, with the arrangement in which the first and second D/A converting sections are respectively composed of either one type of transistors, namely PchMOS transistors or NchMOS transistors, it is possible to allow the first and second D/A converting sections to be formed on separate substrates. In this arrangement, it is possible to ignore voltage drop due to back gate by appropriately setting the standard voltages that are to be supplied respectively to the first and second D/A converting sections, thereby attaining low power consumption in switching of the D/A conversion.

Moreover, the display driving apparatus is preferably arranged such that the standard voltage generating section includes a first standard voltage generating section for generating a standard voltage of positive polarity; and a second standard voltage generating section for generating a standard voltage of negative polarity, the first and second standard voltage generating sections being switched over in accordance with the polarity inverting cycle for the gradation-display-use voltage, so as to operate selectively.

Moreover, the display driving apparatus may be so arranged as to further include: a first output section for receiving the gradation-display-use voltage outputted from the first D/A converting section, and outputting the thus received gradation-display-use voltage to the data signal line of the display panel, the first output section having an output terminal; and a second output section for receiving the gradation-display-use voltage outputted from the second D/A converting section, and outputting the thus received gradation-display-use voltage to the data signal line of the display panel, the second output section having an output terminal, the output terminals of the first and second output sections being connected to each other, and the first and second output sections being switched over in accordance with a value of a highest bit of the display data, so as to operate and be inactivated selectively.

Furthermore, the display driving apparatus may be so arranged that the first output section includes a differential amplifier circuit whose a differential pair at an input stage thereof is composed of NchMOS transistors, and the second output section includes a differential amplifier circuit whose a differential pair at an input stage thereof is composed of PchMOS transistors.

With the above arrangement, the first output section carries out the output operation of the gradation-display-use voltage in the high voltage group, which is outputted from the first D/A converting section. Because of this, the first output section should perform the output operation of the gradation-display-use voltage in high voltage group, but need not perform the output operation of the gradation-display-use voltage in low voltage group. Similarly, the second output section should perform the output operation of the gradation-display-use voltage in low voltage group, but need not perform the output operation of the gradation-display-use voltage in high voltage group.

Because of this, for example, even in case where the first output section includes a differential amplifier circuit whose a differential pair at an input stage thereof is composed of NchMOS transistors, and the second output section includes a differential amplifier circuit whose a differential pair at an input stage thereof is composed of PchMOS transistors, the first output section is used to deal with such voltage that the first output section can make output properly from the voltage, while the second output section is used to deal with such voltage that the second output section can make output properly from the voltage.

With this arrangement, it is possible to realize gradation display of high quality without distortion in input and output. Further, because always only one of the first and second output sections is used, it is possible to attain low power consumption.

Moreover, the display driving apparatus may be so arranged that the standard voltage generating section receives two input voltages of different levels, and generates standard voltages for respective gradations by resistive division, the standard voltages having voltage values between values of the input voltages, and the input voltages are inputted into the standard voltage generating section via a buffer amplifier.

With the above arrangement, the standard voltage generating section is capable of easily adjusting Y correction values of the plural levels of standard voltages within a range of Y correction value voltages, in accordance with the reference standard voltages supplied via the adjustment-use buffer amplifier the reference voltage, the plural levels of standard voltages being generated by the resistance division. When the present invention is applied, for example, in a liquid crystal display apparatus, this attains easy adjustment of the Y correction in accordance with the property of the liquid crystal materials or the property of the liquid crystal panel, without newly designing the display driving apparatus (for example, the source driver).

Further, it is not necessary to supply the intermediate level standard voltages from outside, because the arrangement of the standard voltage generating section and the buffer amplifier makes it possible to generate desired intermediate level voltages. Thus, it is possible to attain a smaller circuit size and reduction in number of terminals, thereby reducing manufacturing cost of the display driving apparatus.

Moreover, the display driving apparatus may be so arranged that the standard voltage generating section includes a modulator for arbitrarily modulating levels of two input voltages that are to be supplied to the standard voltage generating section.

For example, for some liquid crystal modules, it is expected that the standard voltages from the power source circuit need be newly designed each time.

Moreover, the display driving apparatus may be so arranged that the buffer amplifier is capable of being selectively operated and stopped in accordance with a control signal supplied from an exterior control terminal.

With the above arrangement, it is possible to attain further lower power consumption in the standard voltage generating section.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display driving apparatus for supplying a gradation-use voltage to a data signal line of a display panel, the gradation-use voltage being inverted in polarity in a predetermined polarity inverting cycle, and being adjusted in accordance with display data, the display driving apparatus comprising:

a standard voltage generating section for generating standard voltages;

a separating section for separating the standard voltages generated by the standard voltage generating section into a high voltage group and a low voltage group, the standard voltages in the high voltage group having the same polarity as the standard voltages in the low voltage group;

a first D/A converting section for (a) receiving the standard voltages in the high voltage group, (b) selecting one of the thus inputted standard voltages in the high voltage group in accordance with the display data, and (c) outputting the thus selected standard voltage as the gradation-display-use voltage; and a second D/A converting section for (d) receiving the standard voltages in the low voltage group, (e) selecting one of the thus inputted standard voltages in the low voltage group in accordance with the display data, and (f) outputting the thus selected standard voltage as the gradation-display-use voltage.

2. The display driving apparatus as set forth in claim 1, wherein:

the first D/A converting section includes switches and selects one of the standard voltages in the high voltage group by controlling open/close of the switches in the first D/A converting section, the second D/A converting section includes switching and selects one of the standard voltages in the low voltage group by controlling open/close of the switches in the second D/A converting section, the switches in the first D/A converting section are all PchMOS transistors, and the switches in the second D/A converting section are all NchMOS transistors.

3. The display driving apparatus as set forth in claim 1, wherein:

the standard voltage generating section includes:

a first standard voltage generating section for generating a standard voltage of positive polarity; and a second standard voltage generating section for generating a standard voltage of negative polarity, the first and second standard voltage generating sections being switched over in accordance with the polarity inverting cycle for the gradation-display-use voltage, so as to operate selectively.

4. A display driving apparatus as set forth in claim 1, further comprising:

a first output section for receiving the gradation-display-use voltage outputted from the first D/A converting section, and outputting the thus received gradation-display-use voltage to the data signal line of the display panel, the first output section having an output terminal; and a second output section for receiving the gradation-display-use voltage outputted from the second D/A converting section, and outputting the thus received gradation-display-use voltage to the data signal line of the display panel, the second output section having an output terminal, the output terminals of the first and second output sections being connected to each other, and the first and second output sections being switched over in accordance with a value of a highest bit of the display data, so as to operate and be inactivated selectively.

5. The display driving apparatus as set forth in claim 4, wherein:

the first output section includes a differential amplifier circuit whose a differential pair at an input stage thereof is composed of NchMOS transistors, and the second output section includes a differential amplifier circuit whose a differential pair at an input stage thereof is composed of PchMOS transistors.

6. The display driving apparatus as set forth in claim 1, wherein:

the standard voltage generating section receives two input voltages of different levels, and generates standard voltages by resistive division, the standard voltages having voltage values between values of the input voltages, and the input voltages are inputted into the standard voltage generating section via a buffer amplifier.

7. The display driving apparatus as set forth in claim 6, wherein:

the standard voltage generating section includes a modulator for arbitrarily modulating levels of two input voltages that are to be supplied to the standard voltage generating section.

8. The display driving apparatus as set forth in claim 6, wherein:

the buffer amplifier is capable of being selectively operated and stopped in accordance with a control signal supplied from an exterior control terminal.

9. A display apparatus using a display driving apparatus as a data line driving circuit, the display driving apparatus for supplying a gradation-use voltage to a data signal line of a display panel, the gradation-use voltage being inverted in polarity in a predetermined polarity inverting cycle, and being adjusted in accordance with display data, wherein:

the display driving apparatus includes:

a standard voltage generating section for generating standard voltages;

a separating section for separating the standard voltages generated by the standard voltage generating section into a high voltage group and a low voltage group, the standard voltages in the high voltage group having the same polarity as the standard voltages in the low voltage group;

a first D/A converting section for (a) receiving the standard voltages in the high voltage group, (b) selecting one of the thus inputted standard voltages in the high voltage group in accordance with the display data, and (c) outputting the thus selected standard voltage as the gradation-display-use voltage; and a second D/A converting section for (d) receiving the standard voltages in the low voltage group, (e) selecting one of the thus inputted standard voltages in the low voltage group in accordance with the display data, and (f) outputting the thus selected standard voltage as the gradation-display-use voltage.

10. The display apparatus as set forth in claim 9, wherein:

the first D/A converting section includes switches and selects one of the standard voltages in the high voltage group by controlling open/close of the switches in the first D/A converting section, the second D/A converting section includes switches and selects one of the standard voltages in the high voltage group by controlling open/close of the switches in the second D/A converting section, the switches in the first D/A converting section are all PchMOS transistors, and the switches in the second D/A converting section are all NchMOS transistors.

11. The display apparatus as set forth in claim 9, wherein:

the standard voltage generating section includes:

a first standard voltage generating section for generating a standard voltage of positive polarity; and a second standard voltage generating section for generating a standard voltage of negative polarity, the first and second standard voltage generating sections being switched over in accordance with the polarity inverting cycle for the gradation-display-use voltage, so as to operate selectively.

12. A display apparatus as set forth in claim 9, further comprising:

a first output section for receiving the gradation-display-use voltage outputted from the first D/A converting section, and outputting the thus received gradation-display-use voltage to the data signal line of the display panel, the first output section having an output terminal; and a second output section for receiving the gradation-display-use voltage outputted from the second D/A converting section, and outputting the thus received gradation-display-use voltage to the data signal line of the display panel, the second output section having an output terminal, the output terminals of the first and second output sections being connected to each other, and the first and second output sections being switched over in accordance with a value of a highest bit of the display data, so as to operate and be inactivated selectively.

13. The display apparatus as set forth in claim 12, wherein:

the first output section includes a differential amplifier circuit whose a differential pair at an input stage thereof is composed of NchMOS transistors, and the second output section includes a differential amplifier circuit whose a differential pair at an input stage thereof is composed of PchMOS transistors.

14. The display apparatus as set forth in claim 9, wherein:

the standard voltage generating section receives two input voltages of different levels, and generates standard voltages by resistive division, the standard voltages having voltage values between values of the input voltages, and the input voltages are inputted into the standard voltage generating section via a buffer amplifier.

15. The display apparatus as set forth in claim 14, wherein:

the standard voltage generating section includes a modulator for arbitrarily modulating levels of two input voltages that are to be supplied to the standard voltage generating section.

16. The display apparatus as set forth in claim 14, wherein:

the buffer amplifier is capable of being selectively operated and stopped in accordance with a control signal supplied from an exterior control terminal.

* * * * *